United States Patent [19]

Pugh

[11] Patent Number: 4,823,762

[45] Date of Patent: Apr. 25, 1989

[54] ARROW HOLDING AND LOADING DEVICE FOR ARCHERY BOWS

[76] Inventor: Gregory E. Pugh, 13635 Leroy, Southgate, Mich. 48195

[21] Appl. No.: 76,798

[22] Filed: Jul. 23, 1987

[51] Int. Cl.[4] ..... F41B 5/00; F41B 5/02; F41B 5/06

[52] U.S. Cl. ..... 124/52; 124/23 A; 124/45; 124/53; 124/88; 273/416

[58] Field of Search ..... 124/23 R, 23 A, 24 R, 124/24 A, 25, 41 R, 41 A, 41 B, 45, 51 R, 52, 53, 82, 86, 88; 224/916; 273/416

[56] References Cited

U.S. PATENT DOCUMENTS

| | | | |
|---|---|---|---|
| 2,214,224 | 9/1940 | Douglas . | |
| 2,245,187 | 6/1941 | Donash | 273/416 |
| 2,801,625 | 8/1957 | Vose . | |
| 2,909,167 | 10/1959 | Fredrickson | 124/24 R |
| 2,980,097 | 4/1961 | Rothgery . | |
| 2,980,305 | 4/1961 | Reese | 124/23 A |
| 2,984,277 | 5/1961 | Neff | 124/23 A |
| 2,997,999 | 8/1961 | Crowder | 124/23 A X |
| 3,017,874 | 1/1962 | Gubash | 124/23 A |
| 3,034,789 | 5/1962 | Moore | 273/416 |
| 3,116,301 | 1/1964 | Tingley | 124/24 A |
| 3,406,675 | 10/1968 | Fredrickson | 124/24 R |
| 3,527,195 | 9/1970 | Corio . | |
| 3,595,215 | 7/1971 | Wilkie | 124/24 A X |
| 3,716,174 | 2/1973 | Ehlert | 124/41 R |
| 4,038,960 | 8/1977 | Ludwig | 124/41 A |
| 4,247,027 | 1/1981 | Tardiff | 124/24 A X |
| 4,522,187 | 6/1985 | Tafel | 124/24 A |
| 4,541,403 | 9/1985 | De Blois | 124/51 R |

FOREIGN PATENT DOCUMENTS

| | | | |
|---|---|---|---|
| 1470802 | 4/1977 | United Kingdom | 273/416 |

*Primary Examiner*—Dennis L. Taylor
*Assistant Examiner*—John A. Ricci
*Attorney, Agent, or Firm*—Harness, Dickey & Pierce

[57] ABSTRACT

An arrow holding and loading device for an archery bow has a frame to be bolted to the bow so that it can support a carriage that moves horizontally from left to right at the front of the bow to automatically shift a follow-up arrow into shooting position upon release by the archer of an initial arrow. A novel arrow nock having one side longer than the other is disclosed and it enables the bow string to be engaged from the side to facilitate rapid shooting.

54 Claims, 12 Drawing Sheets

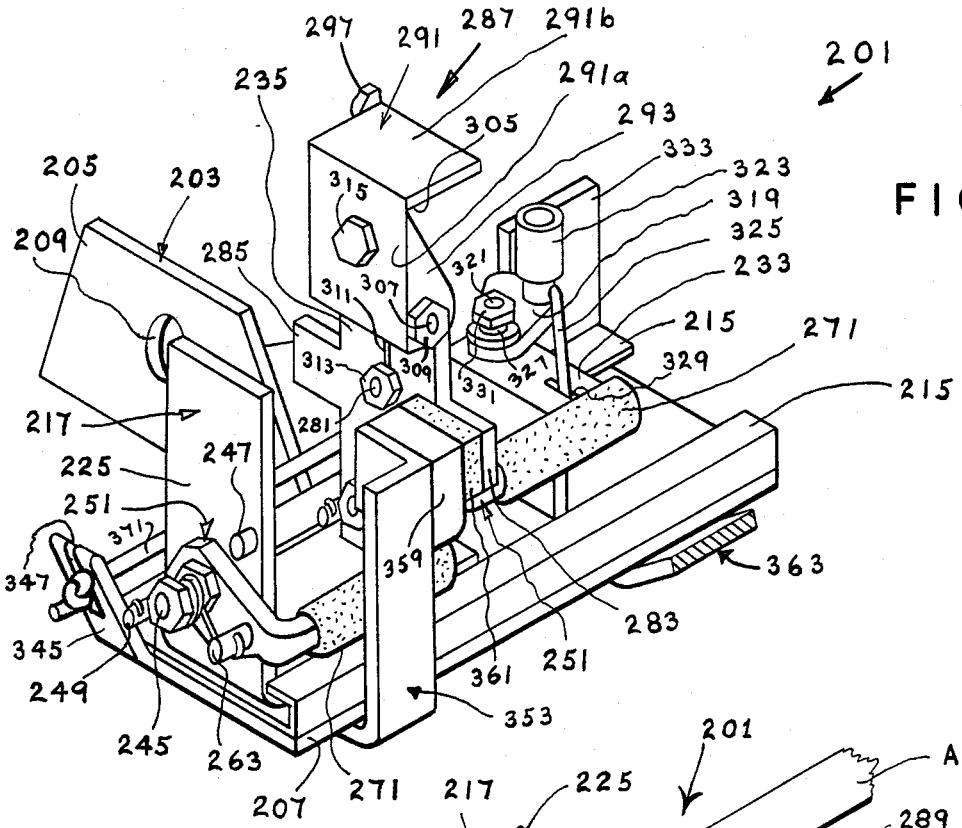
FIG. 12
FIG. 11
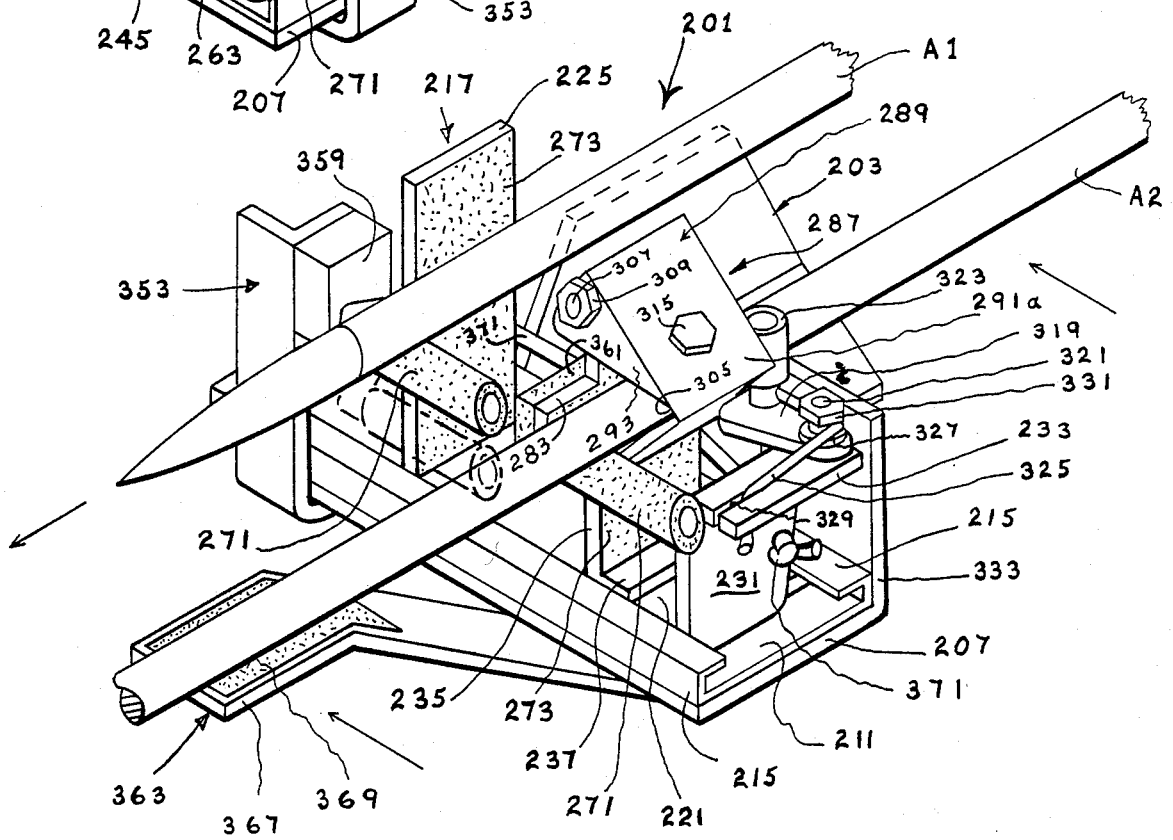

ARROW HOLDING AND LOADING DEVICE FOR ARCHERY BOWS

BACKGROUND OF THE INVENTION

In the sport of archery, and in bow hunting, the archer often wants to be able to make one or more follow-up shots. The value of these shots depends, of course, on the speed and accuracy with which they can be made. Minimizing the action and attention required of the archer will tend to increase speed and accuracy. In hunting, it is also important that the follow-up shots involve a minimum disturbance of the environment, i.e., minimum noise and motion.

BRIEF SUMMARY OF THE INVENTION

My invention relates to a mechanized arrow holding and loading device for bows.

It is a major objective of my invention to provide a follow-up arrow holding and loading device that minimizes involvement of the archer and disturbance of the environment during the brief time before shooting.

The invention accomplishes this objective by means of a structure that holds a follow-up arrow in such a way that it needs to be moved sideways only an inch or so to be ready to shoot. This structure firmly holds the follow-up arrow in a position that is parallel to but transversely separated from the shooting position for an arrow, i.e., the position in which the arrow is longitudinally aligned with the bowstring and ready for nocking, drawing, aiming, and release by the archer.

In preferred embodiments involving automatic operation, the construction is such that shooting of the first arrow releases a carriage holding the follow-up arrow so that the carriage is moved transversely the required inch or so by energy stored in a spring. This movement carries the follow-up arrow into the shooting position. The arrow is firmly held on the carriage by a holding, stabilizing, and clamping mechanism until it is released from this mechanism by the archer when he or she is ready for shooting. The construction is such that more than one follow-up arrow can be held on the carriage and the arrows moved successively into the shooting position. In this case, shooting of the first follow-up arrow releases the carriage to allow it to index transversely for an inch or so to bring the second follow-up arrow into shooting position. Likewise, shooting of the second follow-up arrow triggers action to bring the third follow-up arrow into position and so on.

While it is preferred that the carriage be moved automatically by energy stored in a spring during the loading of arrows on the carriage, manual indexing of the carriage with its follow-up arrow or arrows is within the broad purview of the invention and is illustrated herein.

Similarly, while it is preferred that the holding mechanism be automatically released when the archer grasps and draws the follow-up arrow, manual release is within the broad purview of the invention and is illustrated herein.

The presently preferred embodiment of the invention has a frame with a flange that enables it to be rigidly bolted in place on various kinds of bows that are available on the open market. For a right-handed archer, the frame extends horizontally and to the left of the bow. A carriage is mounted on the frame and it is constructed to support the first or initial arrow in a shooting position, ready to be shot by the archer. The carriage is also constructed to carry one or more follow-up arrows and firmly support them in pre-shooting positions parallel to each other and to the first arrow. The carriage moves from left to right on the frame during unloading of the arrows. For each of the follow-up arrows (but not the first or initial arrow), the carriage has an arrow holding, stabilizing, and clamping mechanism to firmly hold the follow-up arrow in the desired alignment, i.e., the pre-shooting position. This mechanism is designed to release the follow-up arrow automatically when it is brought by the carriage into a position wherein the pre-shooting position coincides with the shooting position and the arrow is drawn to the rear by the archer. The frame includes a retention means that helps to prevent premature release of the mechanism before the follow-up arrow reaches the shooting position, i.e., while the arrow is in the pre-shooting position.

Each support means for each arrow on the carriage may be thought of as a station, with the initial arrow being the first station. Beginning at the last unloaded station, arrows are loaded on to the carriage at the shooting position, the holding mechanism closed, and the carriage moved from right to left. Closing of the holding mechanism stores energy in a spring that urges the mechanism to open but is prevented from doing so by a latch means and, as a back-up, by the retention means.

Movement of the carriage from right to left while loading it with arrows stores energy in a spring means that urges it to move in its direction of operation from left to right, i.e., in order to bring a follow-up arrow into shooting position. Such operative, left to right, movement of the carriage is prevented, however, by engagement of a stop member on the carriage with a fixed stop and alignment face on the frame which is located to place the adjacent arrow in the shooting position. The last station has a fixed stop member to engage the stop face and hold the carriage on the frame. The remaining stations have movable stop members that are spring urged to positions in which they will engage the stop face and therefore prevent rightward movement of the carriage. Preferably, each movable stop member is associated with an arrowrest for supporting the first arrow in the shooting position or a follow-up arrow in the pre-shooting position. When the arrow is shot, a radial projection on the arrow (such as the fletching) rides over the arrowrest to move the movable stop member away from the stop face. As soon as this occurs, the carriage is released and is automatically indexed by the spring means to the next station. It is automatically stopped by engagement of that station's stop member with the stop face so that the arrow in that station is in the shooting position. A manually operated, movable stop face is illustrated herein which the archer can use, if desired, to avoid automatic indexing.

When an arrow is loaded on the carriage, it is preferable that it be angularly adjusted so that the bow string groove in the nock is parallel to the bow string and plane of the bow. Thus, when it is fed into the shooting position, it is only necessary for the archer to draw it straight back to achieve nocking. Nocking is even further facilitated by a feature of the invention wherein the arrow nock is modified to eliminate most of the wall on the side of the groove. When an arrow with the modified nock is loaded on the carriage it is angularly adjusted so that this side of the nock (with minimum wall) is on the bow side and transversely aligned with the bow string. When such arrow is brought into the shooting position, this side of the nock will clear the bow string but the unmodified or full wall will not. Thus, the arrow is put into practically a nocked position by the action of the loading device.

Other objects and features of the invention will become apparent upon consideration of the accompanying drawings and the detailed description of several embodiments.

DESCRIPTION OF THE DRAWINGS

The arrowholding and loading device of the invention (often referred to herein simply as the "loader") is shown in the drawings and described for use on a right-handed bow by right-handed archers. It should be understood that the device could be reversed and face the opposite direction and used on left-handed bows by left-handed archers.

FIG. 11 is a perspective view of another form of loader having two stations and intended especially for use in bow hunting;

FIG. 12 is another perspective view of the loader of FIG. 11.

DETAILED DESCRIPTION OF EMBODIMENTS OF THE INVENTION

Figure 1:
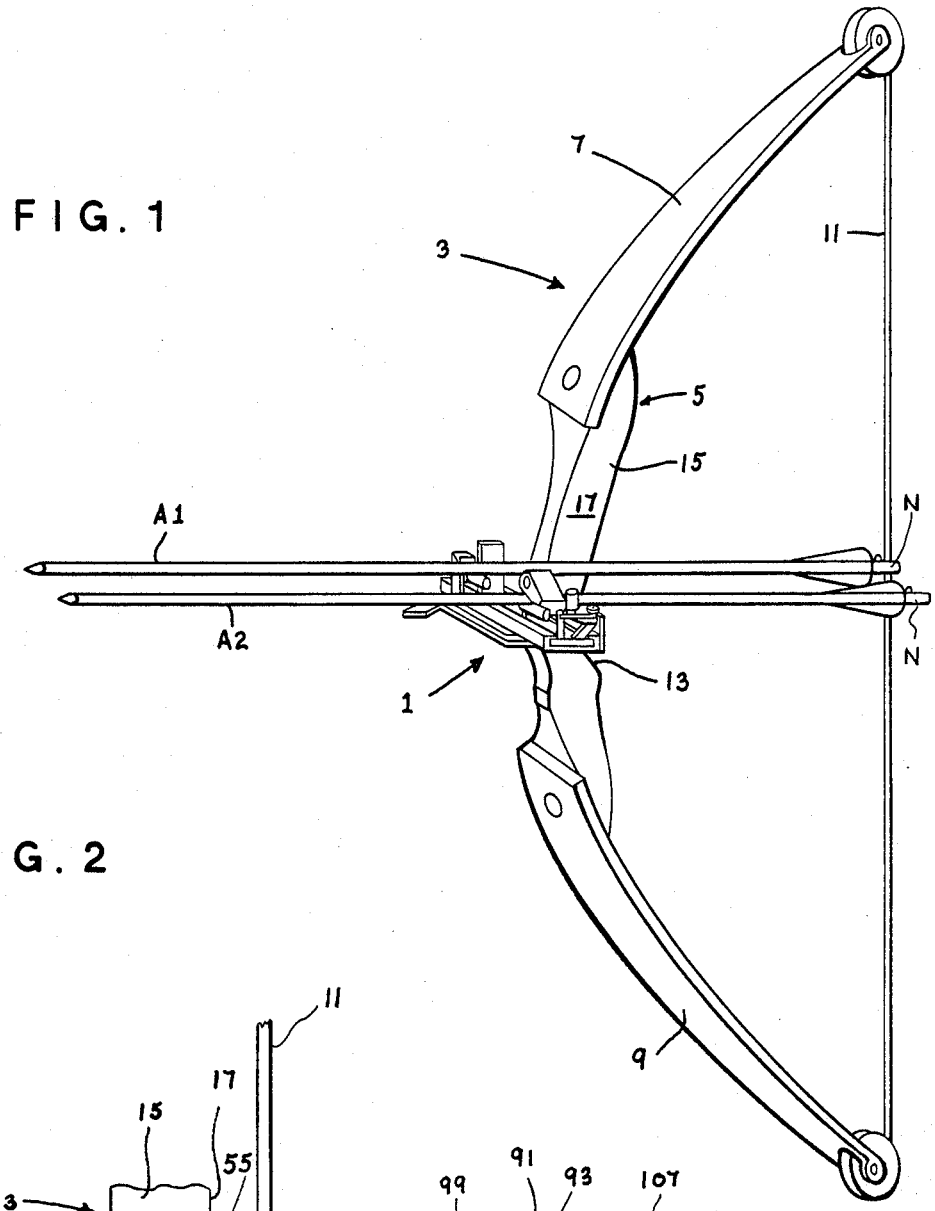
FIG. 1 is a perspective view of an archery bow with a loader according to the invention secured to it.

As seen in FIG. 1, an arrow holder and loader 1, according to the present invention, is shown mounted on a bow 3 which may be any of a wide variety of constructions. The bow 3 illustrated is to be used by a right handed archer and has a central riser section 5 to which are secured upper and lower resilient limb sections 7 and 9, respectively. A bow string 11 is attached by suitable means to the ends of the limb sections and has a nocking point (not shown in detail) that defines one end of a "center line" for the bow 3, the other end being defined by the point where a nocked arrow would be properly supported on the riser section 5 in proper shooting position to be shot by the archer. The "plane" of the bow may be regarded as the plane which contains this center line and the bow string 11.

As is conventional, the riser section 5 has a hand grip portion 13 (FIG. 2) adapted to be grasped by the left hand of the archer. The hand grip portion 13 is located on the left side (as seen by the archer) of the plane of the bow. Just above it and offset to the right of the portion 13 is the offset bow window portion 15 that includes a flat vertical wall (often called the "arrow plate") 17 that is substantially parallel to and located slightly to the right of the plane of the bow.

The arrow holder and loader 1 of this invention has a support frame 23 (FIG. 3) to secure it to the riser 5. It may be formed from sheet metal and have a flat vertical flange section 25 that is in solid contact with wall 17 and securely clamped against it by a bolt and nut assembly 27 that extends through a hole 29 in the portion 15. The support frame 23 includes a flat plate section 31 which projects at right angles to vertical flange section 25 so that it extends to the left of wall 17. It extends also to and beyond the front of the riser section 5 where it provides a substantially rectangularly shaped horizontal shelf **31*a* (FIGS. 2 and 4**) that is normal to the plane of the bow.

Figure 2:
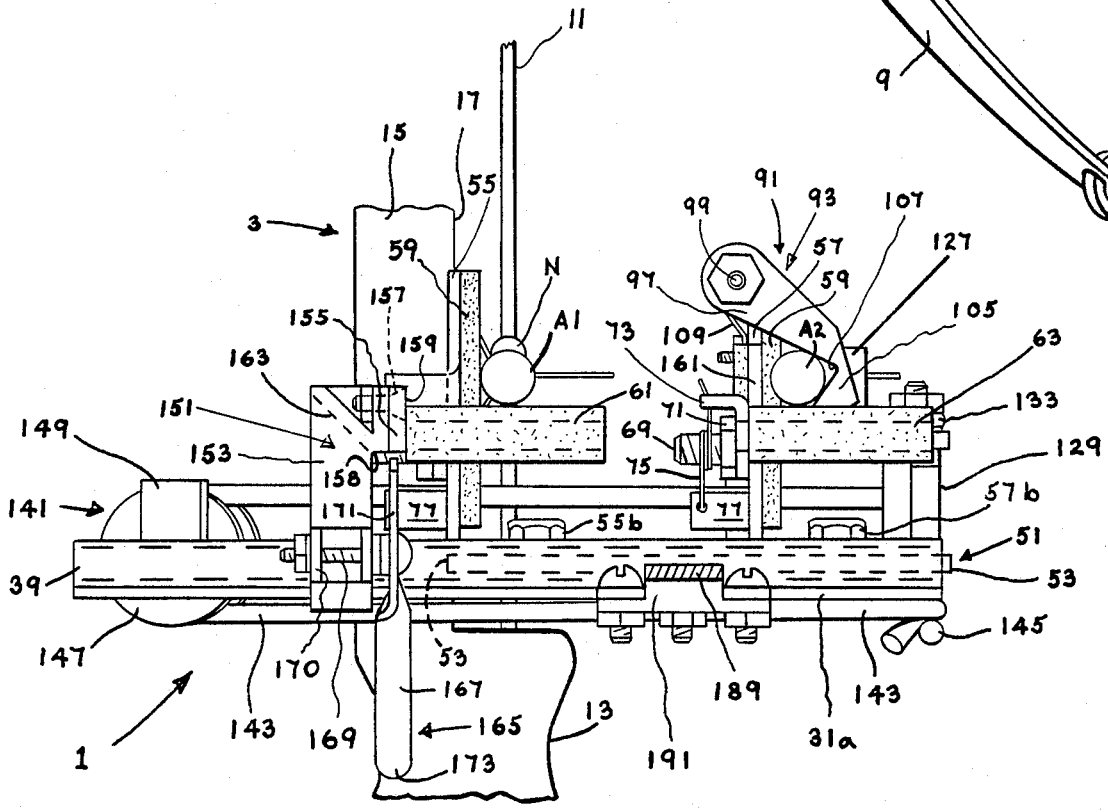
FIG. 2 is an enlarged front elevation of the loader shown in FIG. 1.
Figure 3:
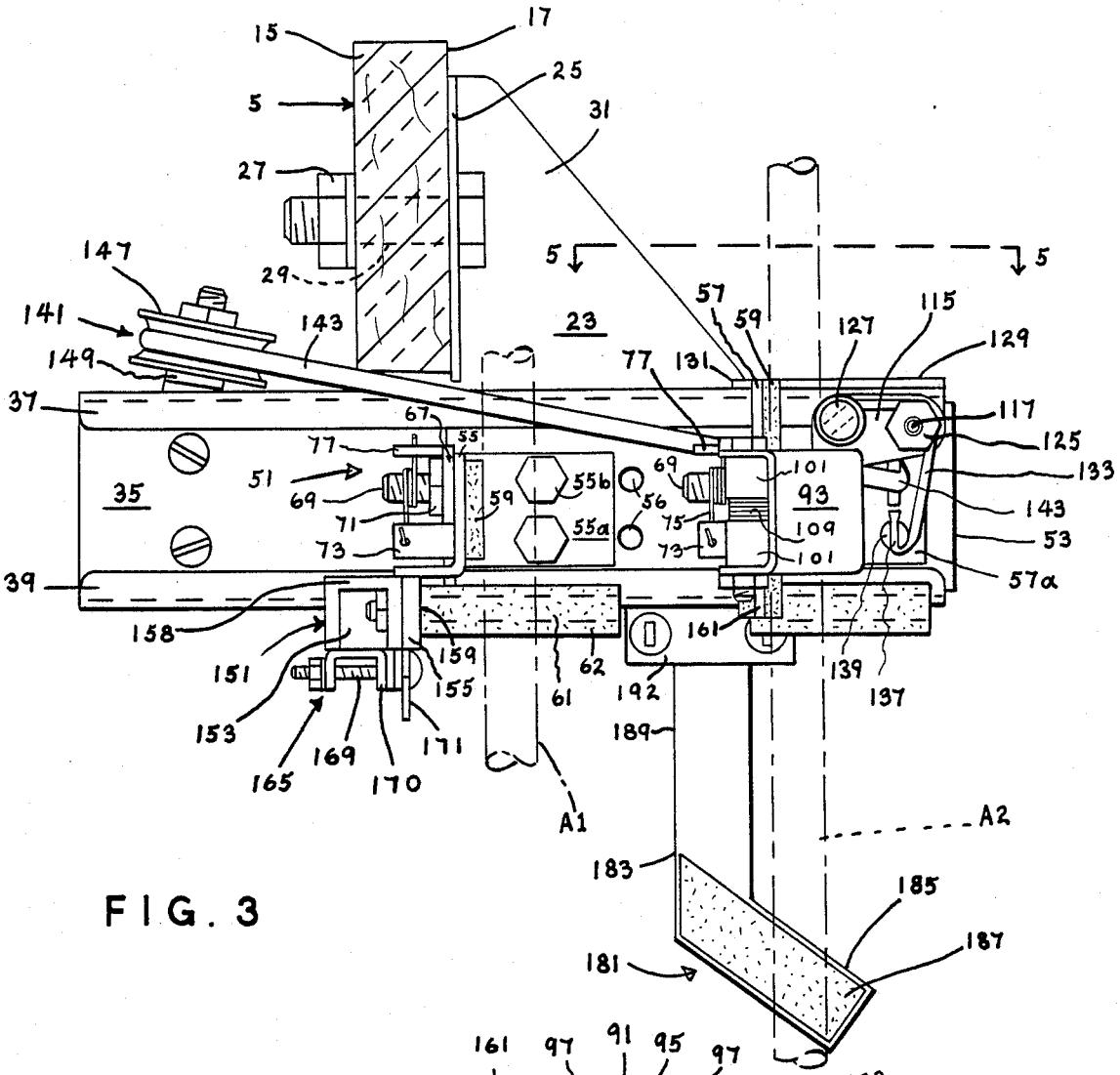
FIG. 3 is a top plan view (with the bow in section) of the arrow loader shown in FIG. 2.
Figure 4:
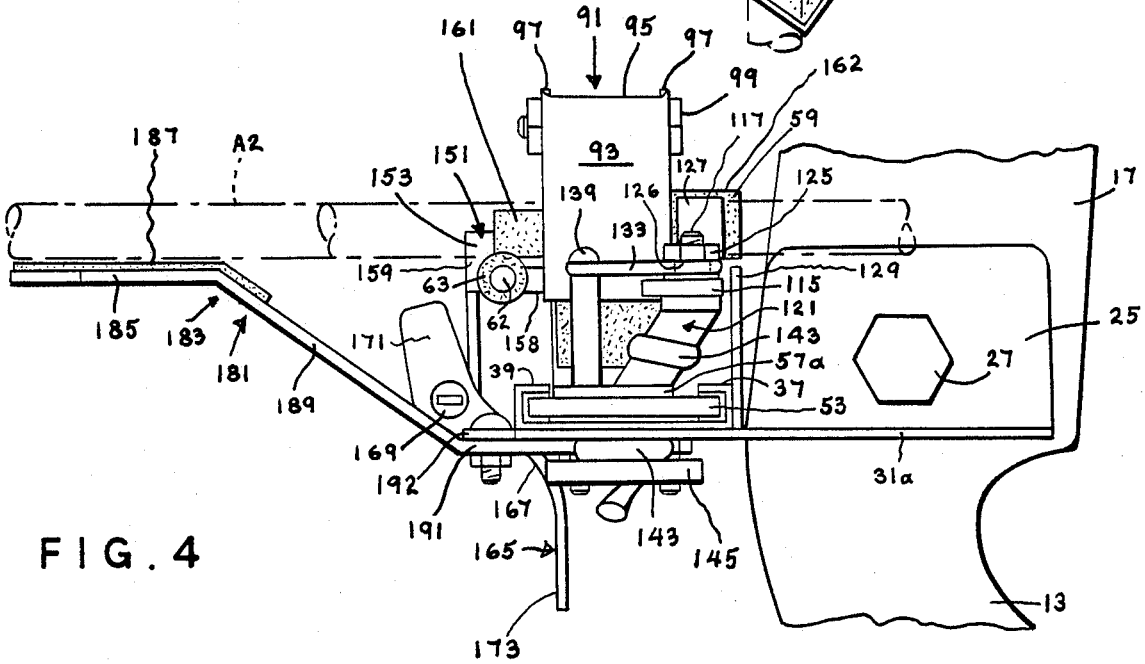
FIG. 4 is a side elevation taken from the right of FIG. 3 of the loader.

A track means or assembly 35 is rigidly attached, as by welding or bolting, to the top of shelf **31*a*** and therefore to the riser section 5. The assembly 35 includes parallel rails 37 and 39 which are in front of the riser section 5 and which extend at right angles to the plane of the bow. As seen in FIGS. 2 and 3 and from the archer's position, a major part of the track assembly is located on the left of the riser section 5. In the embodiment of the invention illustrated, the rails are opposite sides of a C-shaped channel having its back flat against and secured to the top of shelf 31*a* (FIG. 4).

An arrow carriage assembly 51 (to hold and load the arrows) is mounted on the track means 35 provided by the channel shaped rails 37 and 39 to move between a fully loaded postion at the left ends of the rails (FIGS. 2 and 3) and an unloaded position (not shown) at the right ends of the rails. The carriage assembly 51 includes a substantially flat plate-like traveler member 53 that fits in and slides in the channel rails 37 and 39. As seen best in FIG. 6 which shows a loader for two arrows (an initial or first arrow and one follow-up arrow), the member 53 carries two rigid vertical arrow alignment walls 55 and 57 that are parallel to the plane of the bow. Wall 55 is located at the right end of the member 53 (as seen by the archer) and wall 57 is located near but spaced from the left end of the member 53. As will be subsequently recognized, wall 55, in effect, defines a first arrow alignment station for an arrow A1 (which is on the center line of the bow or shooting position ready to be shot); the wall 57 defines, in effect, a second arrow alignment station and pre-shooting position for the follow-up arrow A2. Arrow A2 can be shot when it is moved by the carriage into the plane of the bow so that the arrow A2 is substantially coaxial with the center line of the bow, i.e., in the shooting position.

Wall 55 has a right angle foot or flange 55*a* (FIG. 3) at the bottom which sits on top of plate 53 and is rigidly secured to it by screws 55*b* threaded into pairs of holes 56 in the plate. Additional pairs of holes 56 provide for adjustment of the location of the wall 55. Similarly wall 57 has a right angle foot or flange 57*a* (FIGS. 3–4) at its bottom which sits on top of plate 53 and is rigidly attached to it by screws 57*b* (FIG. 2). If it is desired to hold more than one follow-up arrow, additional vertical walls 57′ defining additional arrow alignment stations (FIGS. 8–10) may be secured to member 53 between first and last walls 55 and 57. This may require a longer member 53 and additional pairs of holes 56.

Figure 9:
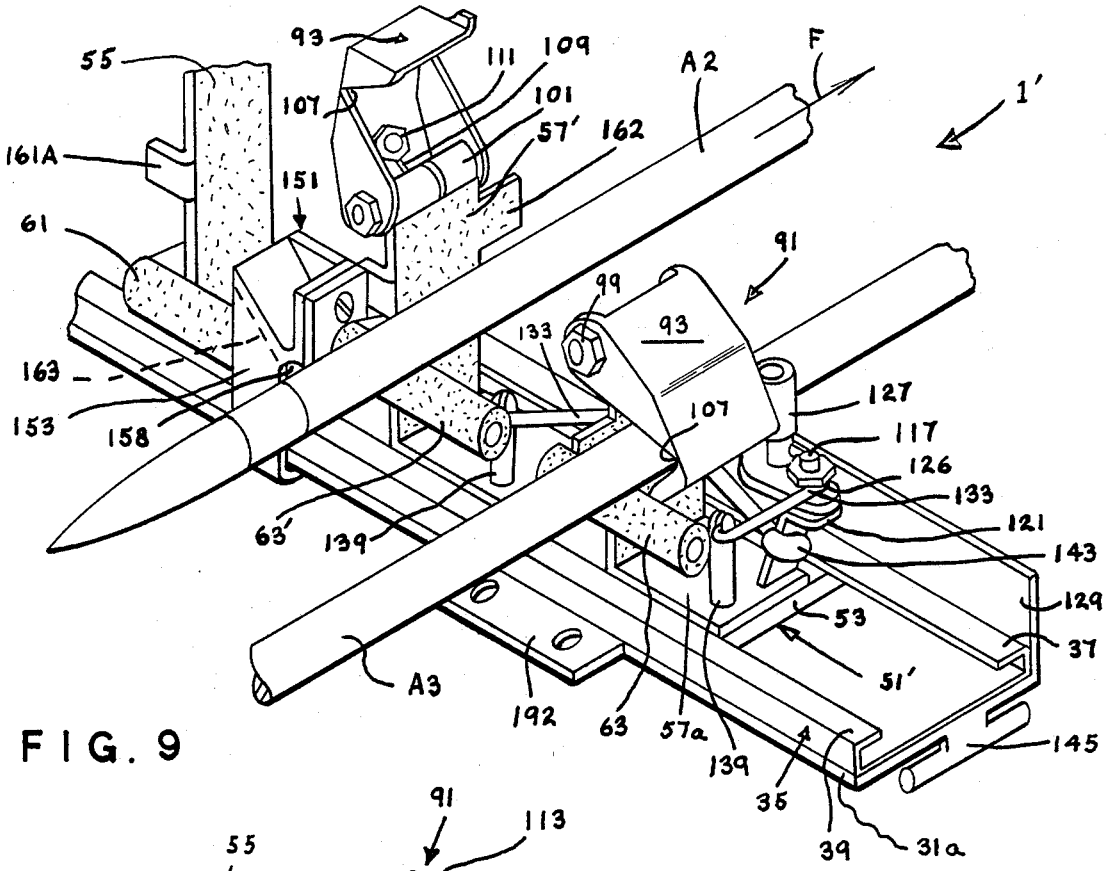
FIG. 9 is a perspective view of a three station loader (with parts omitted for clarity) according to the invention and showing arrow A2 at the second station just about ready to be released by the archer.
Figure 10:
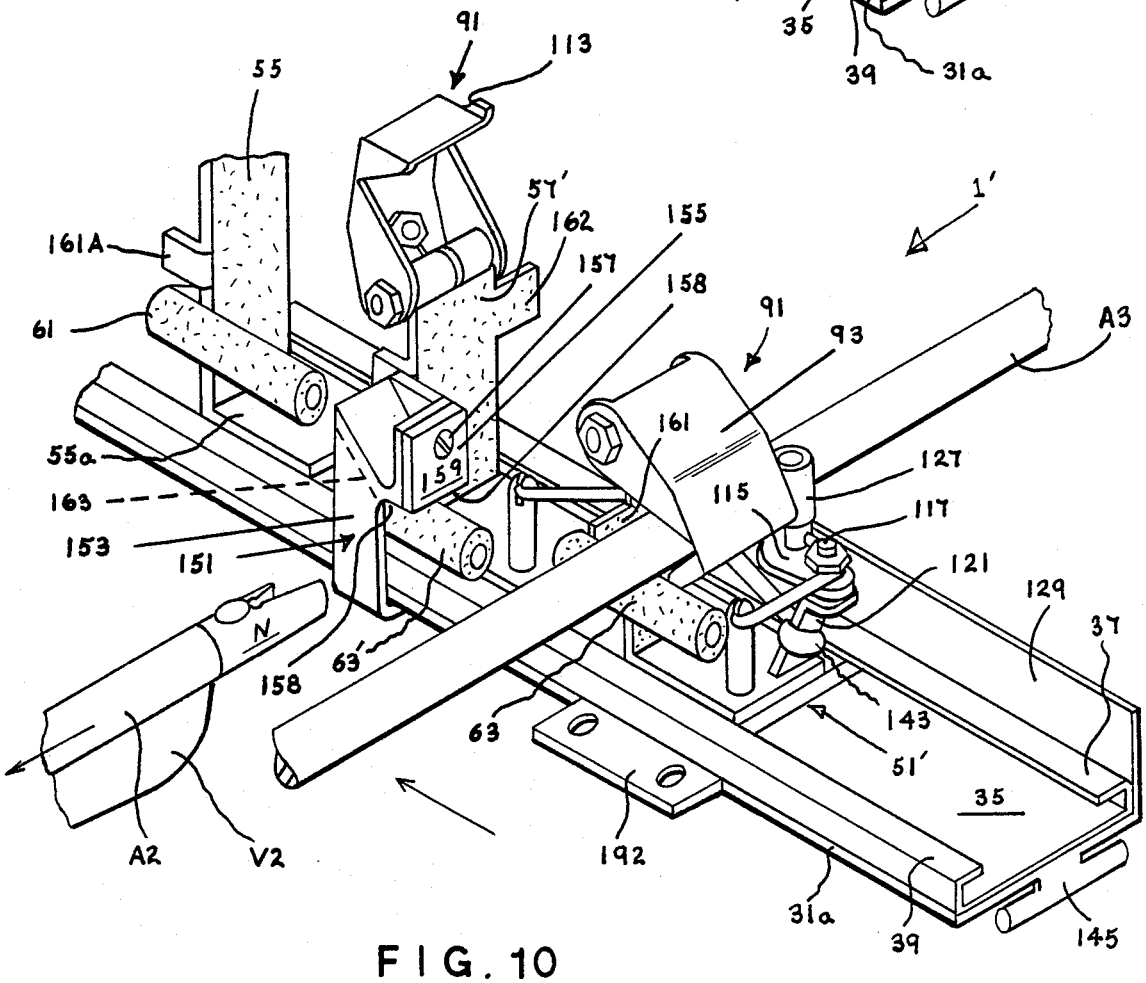
FIG. 10 is a perspective view similar to that of FIG. 9 but illustrates how released arrow A2 has depressed the arrow rest to permit indexing of the carriage.

The left sides of the walls 55 and 57 (and any walls 57′) are preferably each covered with a layer or face 59 of relatively soft, non-metallic, sound-deadening material (such as material identified as "Velcro") and it is these layers which engage, position and guide the arrows A1 and A2 (or A3, etc.) as shown in FIGS. 2 and 3 (and FIGS. 9 and 10).

As also seen in FIGS. 2 to 4, the shafts of the arrows rest on members 61 and 63, respectively, which are basically small metal shafts 62 each covered on the outside with a sleeve or layer of soft non-metallic material (such as "Velcro") corresponding to layers 59. The members 61 and 63 are mounted on vertical walls 55 and 57, respectively, and are movable downwardly from their "up", arrow supporting and guiding positions shown in FIGS. 1–4, when fletching, vanes, or projections on arrows that are released ride over them. In terms of a conventional bow and riser, the layers 59 and walls 55 and 57 serve as arrow plates and the members 61 and 63 serve as arrow rests. The combination of each arrow plate and arrow rest provides what may be regarded as an arrow locator or support means for supporting the arrow in the shooting or pre-shooting position. Movement of the arrow rests tends to reduce deflection of the arrows when they are shot.

As will be described later, movement of members 61 and 63 is used to trigger or control movement of the carriage assembly 51 by a spring motor means. The movable mounting of members 61 and 63 on their respective vertical plates 55 and 57 (or 57′) is substantially the same for each member. Each member is integral or affixed at its right end to the forward end of a lever member 67 that is positioned against the right side of its respective vertical wall 55 or 57 and rockably or pivotally mounted on it by means of a pivot pin 69 (FIG. 5) affixed to the wall so that it is horizontal and normal to the plane of the bow. The right end of the pin 69 is threaded to receive a nut 71 whereby the lever 67 is held against the plate. The lever member 67 has a transverse flange 73 on its top and right side. Pressing upwardly against the underside of the flange 73 and anchored in a hole in it is one end of a piece of spring wire 75 and this yieldably urges the arrow rest member 61 or 63 to the uppermost position shown in the drawings. The wire 75 has a central portion loosely looped around the end portion of pin 69 and its other end is anchored in a hole in flange arm 77 that is integral with the vertical wall but is bent at a right angle, to the right, to the wall as seen best in FIGS. 5 and 6.

FIGS. 1–7 show an arrow holder and loader 1 that supports two arrows (A1 and A2), i.e., a two station mechanism. The first station, for the initial arrow A1, is represented by wall 55; and the second station, for the follow-up arrow A2, is represented by wall 57. Arrow A1 is on the center line of the bow and in shooting position. However, before follow-up arrow A2 can be released, it must be translated or moved transversely to the right (as seen by the archer) so that wall 57 assumes the transverse position now occupied by wall 55. During this movement and during all the period that arrow A2 is supported on arrow rest 63 and wall or arrow plate 57, the archer is concerned with arrow A1 and his hands are not available to held hold arrow A2 in a proper position. Accordingly, the loader 1 includes an arrow holding, stabilizing, and clamping means 91 for each station except the first (i.e., for each follow-up arrow) to firmly hold the follow-up arrows in proper position until they are ready to be grasped and pulled back by the archer.

As seen in FIGS. 1–6, the holder means 91 includes holder and stabilizer member 93 that is movably mounted on the top of wall 57 to pivot about a horizontal axis parallel to the plane of the bow. In side elevation the member 93 has a shape which is somewhat similar to that of a person's forefinger that is bent substantially at the knuckle. This shape enables it to extend around the arrow A2 when it is supported on arrow rest 63 against facing 59 on wall 57. Thus, the member 93 may be formed of sheet metal to have a body wall portion 95 of generally C-shape. Adjacent one end of the C-shape and on opposite sides (i.e., the front and rear) of the portion 95, it is formed to have triangularly shaped parallel flanges 97 that extend at right angles to the portion 95. The flanges 97 have aligned openings to receive a pivot pin 99 (shown in the form of a nut and screw) which extends through and is pivotally supported in a pair of spaced journal portions 101 provided at the top of plate 57, as by bending a pair of flanges at the top of the plate 57 in a clockwise direction (FIG. 7) into a circular shape that defines a pivot axis at the top of and to the right of the plate 57. The inside faces of holder member flanges 97 fit over the end faces of journal portions 101 to hold the member 93 in fixed fore and aft position at all times. The member 93 is arranged so that in arrow holding position it extends downwardly from pivot 99 and on the left or arrow rest side of the plate 57 (or 57' if more than two follow-up arrows are to be carried by the loader). In the holding position it curves around the arrow A2 and has a free (or cantilever-type) end 103 that extends below the top of the arrow rest 63. At the free end and on opposite sides of portion 95 triangularly shaped parallel flanges 105 (FIG. 6) are formed in member 93 which act with the flanges 97 to define a pair of substantially V-shaped notches 107 (one at the front and one at the rear of the member 93). The follow-up arrow A2 fits in notches 107 and is tightly held at two points along its axis by the edges of the notches against the face 59 of plate 57 and against the top of arrow rest 63. The holder 93 thus acts as a stabilizer for follow-up arrow A2 to firmly maintain it in a desired pre-shooting position of alignment and parallel to arrow A1 and the shooting position.

The arrow holding and stabilizing member 93 is manually latched in the operative, arrow holding and stabilizing position of FIGS. 1–5 and automatically released from the latched position when the follow-up arrow A2 is moved by the carriage 51 into the plane of the bow, i.e., into shooting position, and is pulled back by the archer and nocked on the bow string. The holder member 93 is resiliently urged to a release position (FIG. 6) by a spring wire 109 that is wrapped around pivot pin 99 between journal flanges 101 and has one end anchored by a threaded pin and nut 110 in the right side of wall 57 (FIG. 5) and its other end pressed upwardly against and held by nut and screw 111 on portion 95 of the member 93. The latch means to hold the holder member 93 in arrow holding position includes a rigid latch lip 113 on the holder member 93 adjacent the free end 103. The latch means also includes a horizontal latch and clamp plate 115 that pivots off center about a vertical pin 117 and can be manually pivoted against spring resistance over the lip 113 thereby latching the member 93 against clockwise pivoting on its horizontal pivot 99 under the influence of spring wire 109.

Figure 6:
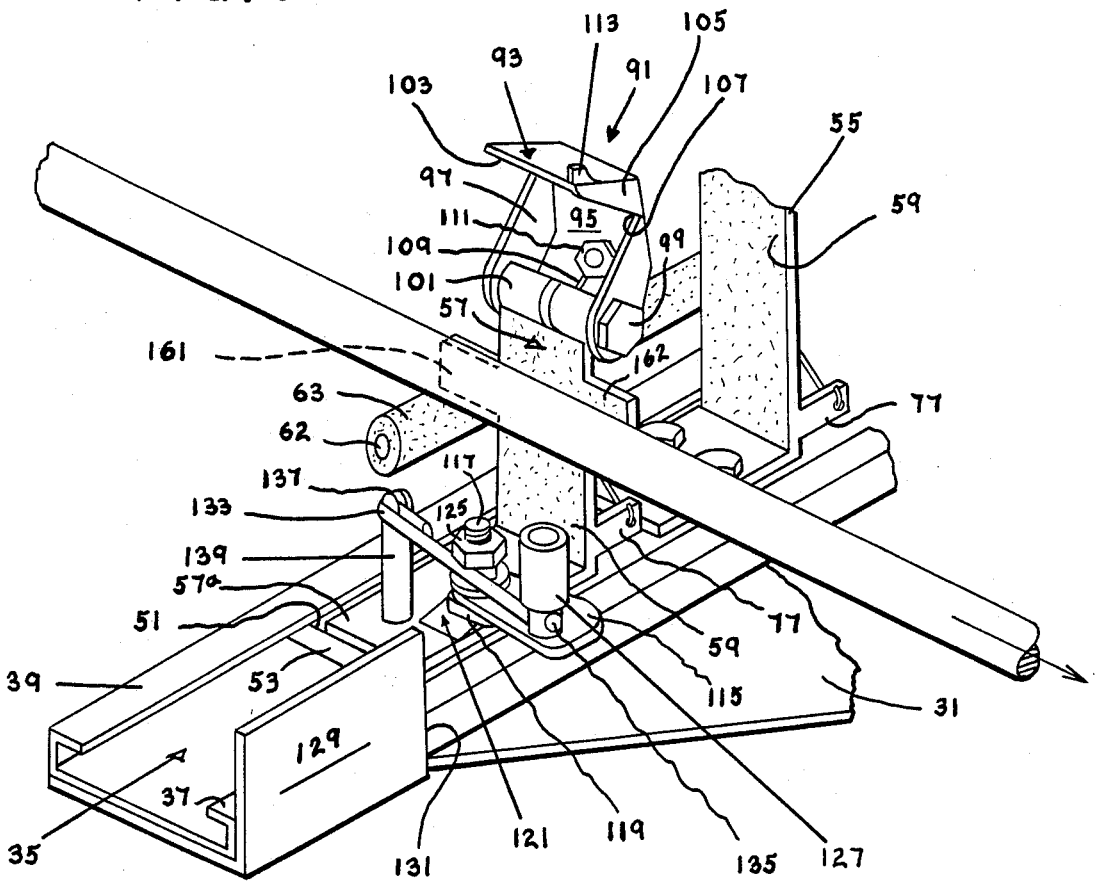
FIG. 6 is a perspective view (with structure omitted) of the loader and intended primarily to show the arrow clamp and clamp latch mechanisms.
Figure 7:
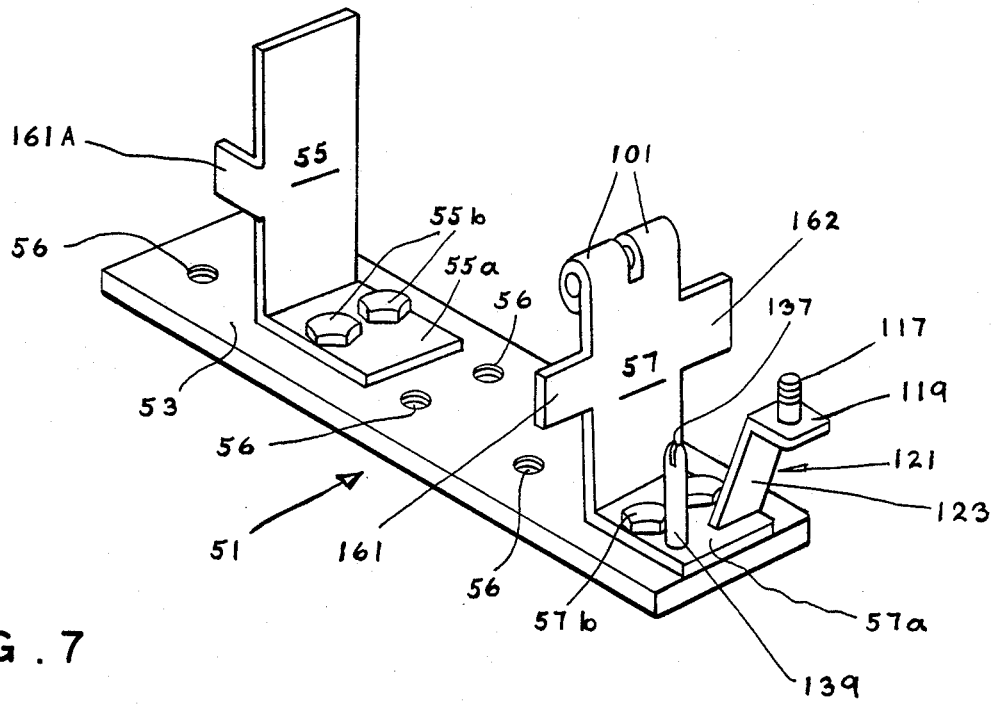
FIG. 7 is a perspective view (with parts omitted) of a two station carriage and shows that the positions of the stations may be adjusted to vary the spacing of the arrows.

The latch and clamp plate 115 is mounted on the horizontal top flange 119 of an inverted substantially L-shaped latch and clamp plate support post 121 which has a leg 123 that is rigidly secured (as by welding) to the horizontal flange **57*a* at the bottom of wall 57 (and 57'). While other arrangements are feasible, for compactness (compactness of the stations resulting in minimum movement to bring a follow-up arrow from a pre-shooting to a shooting position) the flange 119 of support 121 preferably extends toward the left of the archer and the leg 123 is preferably inclined back toward the archer as illustrated in FIG. 7. The latch and clamp plate is pivotally secured to post 121 by means of a nut 125 that is threaded on the end of pivot pin 117 which is rigidly attached to flange 119, there being a space 126 (which may be inside of a spacer sleeve as shown in FIGS. 11–12) to permit passage of elastic cord 133 (FIGS. 4 and 6**).

The latch and clamp plate 115 has a rigid vertical clamp post 127 at one edge which also serves as a handle whereby it can be manually pivoted (against spring resistance to be described) on pin 117 to the latching and clamping position (FIGS. 3 and 5) wherein it overlies the latch lip 113 on holder 93. When the latch and clamp plate 115 is in the latching and clamping position, all of it is normally spaced ahead of the front of a vertical arrow holder retention wall 129 that is at the rear of rail 37 and welded or otherwise rigidly attached to it and/or to shelf **31*a*, thereby making it rigid with the track means 35. The retention wall 129 serves as a barrier that holds the latch and clamp plate 115 in a latched position on lip 113 and therefore holds the holder 93 in an arrow holding position should the normal clamp force between the follow-up arrow and the clamp member 93 be accidentally reduced or lost. The right vertical end edge 131 of wall 129** is located in a selected position that will prevent premature release of the follow-up arrow.

The spring force urging the latch and clamp plate 115 to release the holder member 93 is provided by an elastic cord 133 which has one end anchored on the bottom of post 127 as indicated at 135 and the other end securely held in a slot 137 at the top of vertical spring anchor post 139 which is rigidly attached to bottom flange **57*a* of vertical plate 57. When the latch and clamp plate 115 is moved manually from the unlatched position (FIG. 6) to the latching and clamping position (FIG. 3 or FIG. 10) the elastic cord 133 is stretched (being shown as extending around vertical pivot pin 117 in space 126** so the pull-back force goes over-center) and stores energy.

Figure 5:
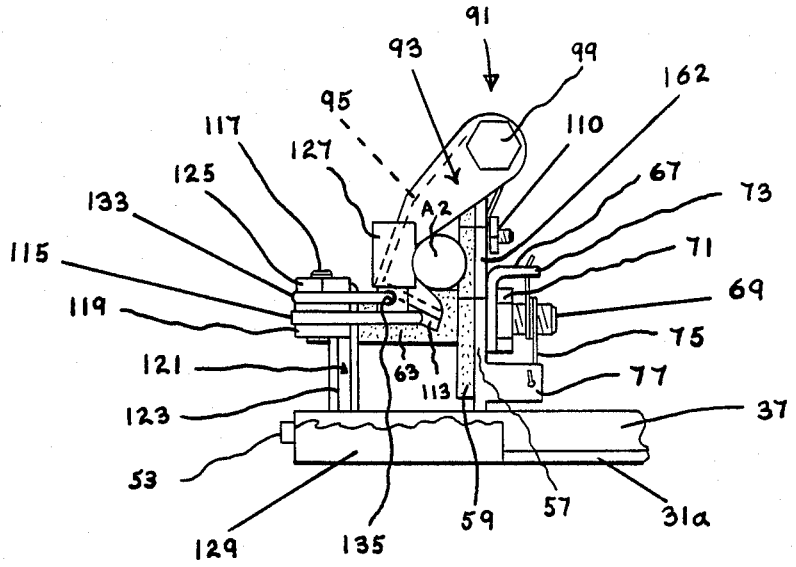
FIG. 5 is a view taken approximately along the line 5—5 of FIG. 3 looking at the back of the left end of the loader as seen by the archer.

As seen best in FIG. 5 in conjunction with FIG. 3, the vertical post 127 on the latch and clamp plate 115 is in engagement with the left side of the follow-up arrow A2 when the plate is in the operative, latching position overlying lip 113. The post is round in cross section (a round cylinder) and its point of contact with the arrow A2 is close to, but not quite, overcenter with respect to the vertical pivot axis of plate 115 on pivot 117. The "on-center" position of the post 127 occurs when its point of contact with an arrow and the axis of pivot pin 117 define a line which is perpendicular to the shaft or axis of an arrow A2 that is properly supported against face 59 of vertical wall 57. The diameter of post 127 is selected (or adjusted by means of an outer sleeve, not shown) so that the width of the space for an arrow between the face 59 and the point of arrow contact with the post 127 is slightly less than the arrow diameter when the post is in the on-center position. Thus, when an arrow A2 is actually in place, the post 127 cannot be readily forced to go forward beyond the on-center position. However, it can be forced against the side of arrow A2 and this presses the arrow into the soft facing 59 with sufficient force to clamp the arrow against the wall 57. The post 127 can therefore be used to manually clamp or wedge the follow-up arrow A2 in the desired position and the friction associated with the clamping force is sufficient to exceed the force in elastic cord 133 tending to pivot latch 115 to an unlatched position. If an external force is accidentally applied to follow-up arrow A2 that is sufficient to overcome the friction clamp, the arrow is still held in the proper position by the holder 93 until the latch and clamp plate 115 is allowed by wall 129 to pivot away from holder lip 113.

A spring motor means 141 is used to move the carriage 51 to the right in the track means 35. The spring means stores energy when the carriage is manually moved to the left to the loaded position. As illustrated, the means 141 is also preferably in the form of an elastic cord 143 of one or more strands which is stretched between a fixed anchor on the track means (or other non-movable part such as riser 5) and an anchor on the carriage 51 and is long enough to supply the required energy at the required rate. The fixed anchor 145 is shown on the bottom of shelf 31*a* near the left end of the track means while the support post 121 can conveniently be used as the carriage anchor. The cord 143 is stretched from its anchor 145 at the left end of the track means along the bottom of the shelf 31*a* to a pulley 147 that is pivotally mounted at an angle on a rearwardly extending rigid bracket 149 at the right end of the track means. The cord 143 is trained around the pulley to reverse direction so that it extends leftwardly over the top of the track means 35 and traveler plate member 53 to reach its anchor at post 121. The elastic cord is stretched as the carriage 51 moves to the left, away from the pulley 147, and therefore continuously applies force to the carriage at post 121 urging it to move back to the right.

A stop and station positioning means 151 is provided to control and properly align the transverse positions of the carriage 51 on the track means 35, i.e., with respect to the plane of the bow so that initial and follow-up arrows are positioned in the shooting position with their centerlines coaxial with the centerline of the bow. The stop and positioning means includes a vertical bracket 153 that is rigidly attached to the self 31*a*, i.e., to the track means 35. At the top and on the left side, the bracket 153 is spaced above and extends over the top of front rail 39 and has a stop member 155 that is preferably removably attached to the bracket as by a recessed screw 157 threading into an integral pad at the overhanging top 158 of the bracket. The left side of the stop member 155 is a vertical, flat stop and alignment face 159 that determines where the carriage 51 will be positioned. The stop member 155 can be easily removed and replaced by another which is thicker or thinner in order to provide for transverse adjustment of the carriage stop to suit the diameters of the arrows being used and obtain the desired alignment of the arrow with the bowstring or the centerline of the bow, i.e., to place the arrows in the correct shooting position for the bow. Shims or other stop position adjustment means can be used if desired. Shims can also be used behind the Velcro faces 59 to adjust for the use of smaller arrows.

The stop face 159 is located in transverse alignment with the arrow rests 61 and 63 when the latter are in their elevated, functional, arrow supporting, positions. The right ends of the arrow rests will therefore butt against the stop face and act as stop members. Since the arrow rests are a part of the carriage 51 and the stop face 159 is a part of the track means 35, such abutment will prevent movement of the carriage 51 to the right under the influence of the spring motor 141.

As described above, the arrow rest members 61 and 63 are movable downwardly from their stop face engaging positions just described, such downward movement being caused by radial projections (such as vanes, fletching, feathers, or other device of sufficient stiffness) on a released arrow riding across the member. Such downward movement of a member 61 (for the initial or first arrow A1) that is in abutment with the stop face 159 causes it to lose contact with the stop face and go below the overhang portion 158 of the bracket 153. This removes the obstruction to movement of the carriage 51 by the spring motor 141. It therefore serves as a trigger that releases the carriage so that it is indexed to the right until arrow rest 63 comes into contact with the stop face 159. This brings follow-up arrow A2 still held by member 93 into the shooting position in the plane of the bow, ready to be grasped and nocked, thereby unlatching the holder member 93, so that the arrow A2 can be drawn, aimed, and released by the archer.

In order to positively prevent the spring motor 141 from pulling the carriage 51 out of the track means 35, the vertical plate 57 at the left end of the carriage, i.e., the last plate or station to reach the stop face 159, has a transverse arm portion 161 in alignment with the face 159. This will abut against the stop face when the last station reaches the plane of the bow. This abutment will therefore serve to hold the carriage 51 in the track means until it is manually moved to the left against resistance of the elastic cord 143. Intermediate vertical walls 57' for intermediate stations (and the first wall 55) do not have transverse arm portions 161. If for production reasons, the walls 55 and 57' have arms, they are bent parallel to the track means 35 as seen at 161A (FIGS. 7–10) and miss the stop face 159. The vertical plates 57 and 57' also have rearwardly extending transverse arms 162 which are aligned with posts 127 and provide a back-up to pressure applied to the follow-up arrows A2, A3, etc. by the post 127 to prevent canting of the arrows due to the clamping load. The arms 161 and 162 have facing 59 and are vertically aligned with the arrow (FIG. 6) to increase the length of contact between arrow and plate. It will be noted in FIGS. 2, 4, 6 (and FIGS. 9–10) that the arms 161 and 161A lie over the right ends of arrow rests 61 and 63 and limit their upward movement, i.e., define their arrow supporting positions. To facilitate leftward movement of the carriage, the bracket 153 has an inclined wall or cam surface 163 that engages the left end of each arrow rest to cam it down below overhang 158. (See FIGS. 2, 9, and 10).

Manually operated stop means 165 (FIGS. 2–4) can be selectively operated as desired to obstruct rightward or operative movement of the carriage 51. This includes a vertically disposed lever 167 that is pivoted on a horizontal axis by threaded pivot pin 169 which is mounted in two walls of a bifurcated bracket 170 that is rigidly secured on the front of vertical stop bracket 153. The pivot pin 169 is preferably a screw and nut assembly that extends through a hole in the lever and applies pressure to the lever so that the tightness of the screw and nut adjusts and controls the ease of pivotal movement of the lever by increasing or decreasing frictional resistance to pivotal movement. The top of the lever 167 is in the form of a flat stop face portion 171 that can be positioned to lie about 1/16 inch under overhang 158 and just to the right of face 159 in the path of movement of the arrow rests 61 and 63 when they are in the lowered position wherein they would pass beneath the overhang 158 of stop bracket 153. Portion 171 would therefore stop the carriage 51 and prevent its indexing when an arrow is released. The lever 167 has a handle portion 173 shaped like a trigger at its bottom portion to provide means for the archer to use the forefinger of his left hand while holding the hand grip 13 of the bow 3 to operate the lever 167. If he pulls the trigger 173 the top 171 is pivoted out of the path of the carriage 51; and if he pushes the trigger the top 171 will move into the path of the arrow rests 61 and 63. If desired, the lever 167 could be spring biased to return to the carriage blocking position, as by connecting an elastic cord (not shown) between the top 171 and bracket 153 so that it is stretched when the lever is pivoted to the release position.

An arrow stabilizer means 181 is preferably used to help the arrow holder and stabilizer 93 support follow-up arrows A2, etc., that are carried by the loader 1. The means 181 comprises a bracket 183 that has a horizontal shelf 185 spaced in front of the loader (FIG. 4) on a horizontal level with the tops of the arrow rests 61 and 63. The shelf 185 preferably has a Velcro-type padding 187 corresponding to that on the arrow rests. The shelf 185 preferably angles forwardly and to the left (FIG. 3) and extends far enough to the left to be able to allow for transverse adjustments of the positions of walls 57 or 57' relative to wall 55 and to support all follow-up arrows carried by the loader (i.e., arrows A3, A4, etc., if more than two stations are used.) The shelf portion 185 is at the top and front end of the stabilizer bracket 183 and the latter has a downwardly and rearwardly extending strut portion 189 which is rigidly secured by screws, welding, or the like at its bottom portion 191 to the bottom of a flange 192 at the front of shelf 31*a*.

To review briefly, the arrow holding and loading device 1 is mounted on bow 3 by means of a support frame 23 which is integral with a track means 35. A carriage 51 indexes horizontally at right angles to the plane of the bow on the track means. The carriage 51 has a plurality of arrow support stations. The first station is for the initial or first arrow A1 to be shot and is defined by the wall 55 and arrow rest 61. The second station is for the follow-up arrow A2 and is defined by the wall 57 and arrow rest 63. It is parallel to but transversely separated from the first station by a very short distance, preferably in the range of 1.0 to 1.5 inches or less. Since follow-up arrow A2 must be supported while initial arrow A1 is being aimed and shot and since it must be moved into the shooting position in the plane of the bow, the second (and subsequent) stations have a holding, stabilizing, and clamping means 91 for holding the follow-up arrow tightly on the carriage. Arrows in the second (and subsequent) stations are additionally stabilized, if desired, by resting on the shelf 185 of stabilizer means 181. The device therefore contacts each follow-up arrow at several axially spaced points along its length to firmly hold it in a pre-shooting position parallel to the shooting position during movement of the bow and the vibration associated with release of an arrow.

A latch means including latch and clamp plate 115 is provided to latch each holder and stabilizer member 93 in operative position wherein the arrow is seated in V-shaped notches 107 which are preferably sized to provide pressure to clamp the arrow A2 against face 59 and wall 57. Post 127 on latch and clamp plate 115 also applies enough clamp force to the arrow A2 to overcome spring means 133 which urges the latch and clamp plate 115 to release the arrow. The plate 115 is not permitted to move from latch lip 113 on holder 93 until the plate 115 passes by the edge 131 of latch holder wall 129 during rightward index movement of the carriage 51 and the friction force holding post 127 against the arrow A2 is overcome.

The carriage 51 is indexed automatically in its operative direction from left to right by the spring motor 141. However, indexing cannot occur if the arrow rest 61 (or the arrow rest 63'-FIGS. 9–10) is in the up position because of abutment of the right end of the arrow rest with the stop face 159. However, when an arrow is released, the movable arrow rest 61 (or arrow rest 63') is forced down by the vane, etc. on the arrow. This moves the arrow rest out of engagement with the stop face 159 and the carriage is then automatically indexed to the right (assuming stop means 165 is out of the way) until the next arrow rest 63 abuts against the stop face 159 thereby positioning the next arrow in the shooting position. Indexing can be prevented by manual operation of the finger actuated stop means 165 to place stop face 171 in the path of the depressed arrow rest.

Figure 8:
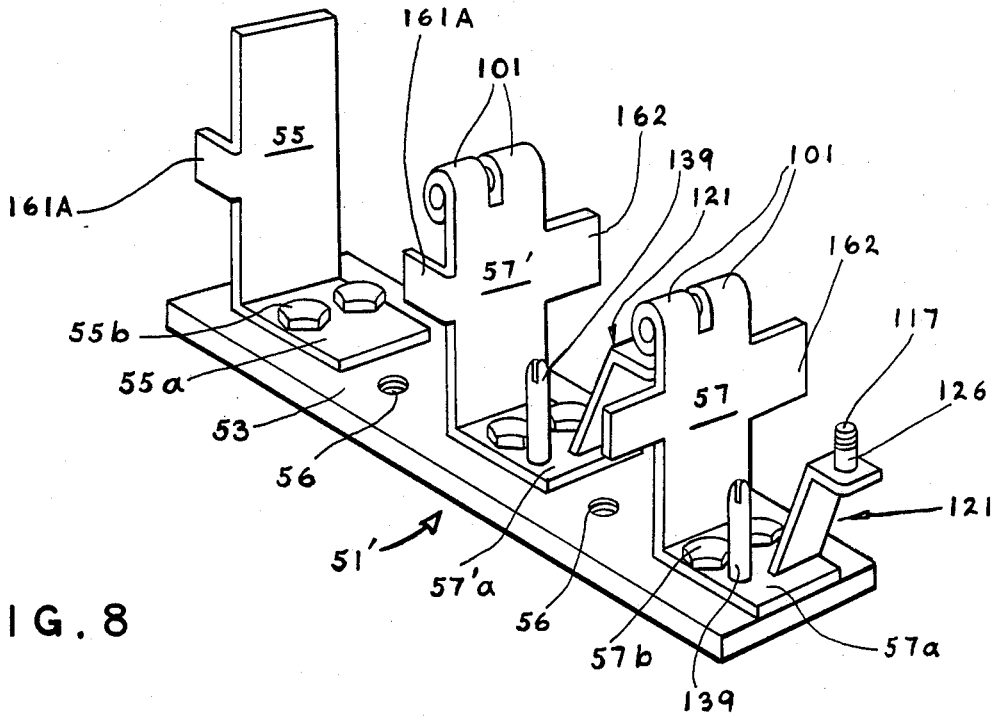
FIG. 8 is a view similar to FIG. 7 but shows a three station carriage.

FIGS. 1–7 refer to a loader 1 that is and adapted to carry two arrows, i.e., a two station loader for a first arrow and one follow-up arrow. However, as seen in FIG. 7, the carriage traveler plate 53 may if necessary be lengthened and provided with extra pairs of openings 56 to receive screws 55*b* or 57*b*. Thus, a third vertical plate 57' may be attached to the plate 53 as shown in FIG. 8, plate 55 also being moved to a right-end position to provide for equal spacing of the plates 55, 57' and 57 and formation of a three station carriage 51'. As seen in FIG. 6 the vertical plate 57 with its bottom flange or foot 57*a* serves to support all the mechanism for a follow-up station (movable arrow rest, arrow holding, stabilizing, and clamping means) and can be produced as an operative subassembly to be attached to different carriages or to different positions on a given carriage. The same is true of plate 57' with its foot 57'*a* and attached parts like plate 57.

The structure of FIG. 8 is used in the three station loader 1' of FIGS. 9 and 10 wherein the reference numbers used in FIGS. 1–7 are used to describe the same structure in FIG. 8. FIG. 9 shows the loader 1' just after first or initial arrow A1 (not shown) has been released (arrow rest 61 is still somewhat depressed) and the carriage 51' has indexed to the right until the arrow rest stop member 63' for the second station has abutted stop face 159. The archer has applied force to follow-up arrow A2 in the direction of reference arrow F (FIG. 9) and this has broken the friction of the clamp grip between latch post 127 and arrow A2 to allow spring cord 133 to pivot latch plate 115 (not shown for clarity) so that it moves away from lip 113 allowing spring 109 to pivot the holder 93 up and out of the way of the first follow-up arrow A2. The parts remain in the position of FIG. 9 (except that arrow rest 61 will rise along surface 163 toward the bottom of arm 161A) until the archer has released the follow-up arrow A2.

FIG. 10 shows the loader 1' an instant after the archer has released the first follow-up arrow A2. The radial vane or fletching V2 has passed across arrow rest 63' and depressed it below stop face 159 so that spring cord 143 has started to pull the carriage 51' to the right. It will move to the right until arrow rest 63 for the third station abuts the stop face 159. Assuming that latch post 127 hasn't been dislodged from its friction clamp against arrow A3, the second follow-up arrow A3 will remain in clamped position with holder 93 in the operative position shown in FIG. 10 until the archer applies force F to the arrow A3. Even though arrow A3 (the last arrow carried by the loader) is released, the carriage 51' will index no further to the right because of contact of arm 161 with the stop face 159.

After the last follow-up arrow A3 has been shot, the device may be reloaded. This is done when the station is in shooting position (i.e., to the right of the end 131 of wall 129) and in reverse order (i.e., A3, A2, and A1) because of retention wall 129. Thus, arrow A3 is clamped in position on wall 57; the carriage is pushed to the left until member 63' is cammed under overhang 158 whereupon arrow A2 is clamped in position on wall 57'; the carriage is pushed again to the left until arrow rest 61 is cammed under overhang 158 whereupon the first arrow A1 is supported against wall 55 on rest 61 and in the shooting position for the bow.

It will be seen that the arrow holding and loading devices 1 and 1' of FIGS. 1–10 can be used with a wide variety of bows to provide an archer with one or more fast follow-up shots using arrows A2, A3, etc. The stations for the respective arrows can be placed very close to each other so that the arrows are only an inch or so apart. The follow-up arrows are parallel to the first arrow A1 in the shooting position and need only be moved sideways by carriage 51 or 51' for an inch or so to be delivered to the shooting position from the last pre-shooting position. This small movement minimizes visual disturbance of the environment. The various metal parts can be well lubricated and/or padded to minimize noise and auditory disturbance of the environment. Shooting of the first arrow A1 triggers automatic movement of carriage 51 or 51' to deliver the first follow-up arrow to the shooting position, ready for nocking, drawing, aiming, and release by the archer. Similarly, shooting of the first follow-up arrow A2, triggers automatic delivery of the second follow-up arrow A3 to the shooting position, ready to be shot by the archer. This automatic delivery of each follow-up arrow, along with the small amount of sidewise movement of the arrow, enables the follow-up arrow to be nocked and shot very rapidly, especially if the special nock N of FIG. 10 (described hereinafter in connection with FIGS. 28–29) is used on the arrow. The device 1 or 1' can enable the archer with experience to release follow-up arrow A2 within about two seconds after release of arrow A1. The fast, automatic delivery of the follow-up arrows A2, A3, etc. also improves accuracy because the archer's attention and movements can be focused almost exclusively on shooting. It is not necessary for him or her to search for and load the follow-up arrow.

The devices 1 and 1' are sturdy and compact in construction, easy and quiet to use, operate rapidly and smoothly, and can be attached to most bows. They drastically reduce the amount of time between arrow releases. They deliver each of the follow-up arrows consistently to the same position so that the archer can have a smooth, economical, rhythmic, hand-arm motion in shooting. The benefits to the hunter are obvious. For sport archery, the speed of the devices can add another dimension to target shooting by making it possible to quickly and accurately shoot at moving and/or multiple targets.

FIGS. 11–18 show a modified loader 201 which has two stations and is very similar to loader 1. A two station loader is probably best for hunting and the construction 201 is intended to provide a compact device giving reliable performance at a somewhat lower cost of manufacture than loader 1, though the constructions are very similar.

The loader 201 has a support frame 203 (FIG. 12–14) which includes a plate 204 having a vertical flange 205 and a horizontal shelf 207, the flange 205 having a hole 209 whereby the frame may be bolted to the bow (not shown). A C-shaped channel 211 is secured by countersunk screws 213 (FIG. 13) to the top of the shelf 207 and provides front and rear tracks 215.

A carriage assembly 217 for two arrows A1 and A2 includes a traveler or carriage member 219 (FIGS. 15–16) that has a flat bottom plate section 221 that slidably fits on top of channel 211 and has its front and rear longitudinal edges 222 in tracks 215. The member 219 is formed from a flat blank (FIG. 16) and its reduced width right end (as seen by the right-handed archer) is bent at a right angle along line 223 to form a first station vertical wall 225. The blank has a reduced width and specially shaped left end (as seen by a right-handed archer) that is bent at a right angle along line 227 and again at a right angle along line 229 to form a vertical left end section 231 and a horizontal flange section 233 extending to the left from the top of vertical section 231. A second station vertical wall 235 (substantially similar to wall 57) has a horizontal foot flange 237 that is welded to the top of plate section 221 so that second station wall 235 is parallel to the first station wall 225 and spaced the desired distance from it.

Figure 16:
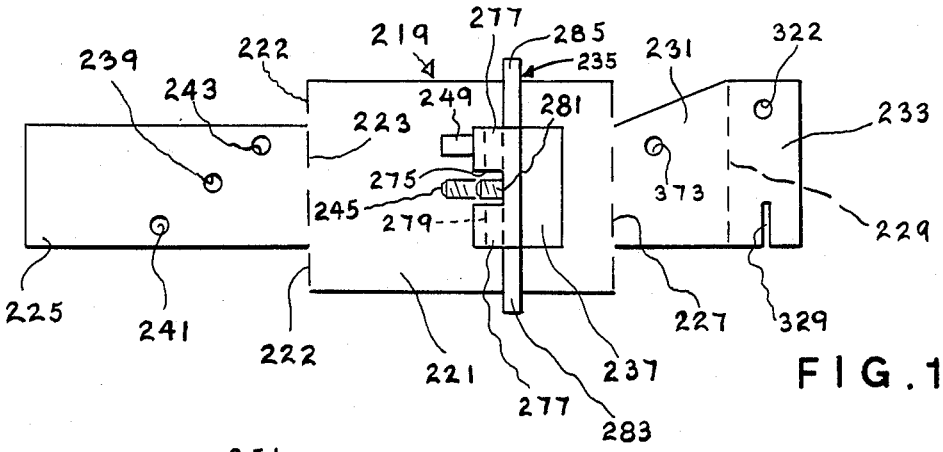
FIG. 16 is a plan view of a part of the carriage assembly of FIG. 15 showing a stage in its formation.

As seen in FIG. 16, the wall 225 has three same size thread openings 239, 241, and 243 formed in it. After the blank is bent into member 219, an arrow rest pivot pin 245 is screwed into opening 239, an arrow rest stop pin 247 is screwed into opening 241, and a spring anchor pin 249 is screwed into opening 243. (These could be welded or press fit connections, if desired.) Wall 235 also has a pivot pin 245 and a spring anchor pin 249, but it does not need a stop pin corresponding to stop pin 247.

Figure 17:
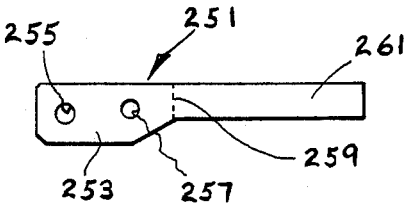
FIG. 17 is a plan view of a part of an arrow rest member shown in FIG. 15 showing a stage in its formation.
Figure 18:
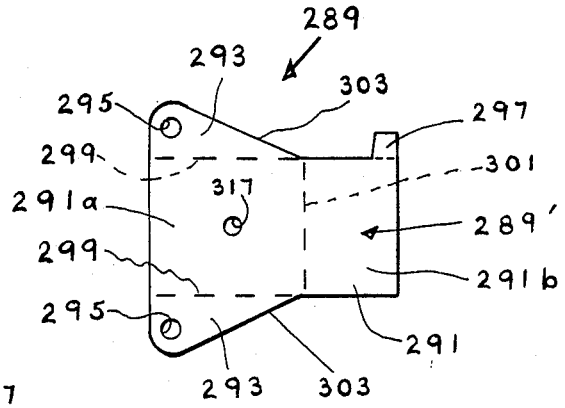
FIG. 18 is a plan view of a clamp member shown in FIGS. 11–12 showing a stage in its formation.

Two arrow rest levers 251 (one for wall 225 and the other for wall 235) are formed from blanks as shown in FIG. 17. Each has a base section 253 with a pivot pin receiving opening 255 (for pivot pin 245) and a threaded opening 257. The blank has reduced width section that is bent at a right angle along line 259 to form the arrow rest support arm 261. An arrow rest spring anchor pin 263 (FIG. 15) is threaded into opening 257.

A pair of axially separated nuts 265 are threaded on to each pivot pin 245, one of them engaging the base section 253 of each lever and the other serving to press the coiled center section 267 of an arrow rest return spring wire 269 which fits over the pin 245 against the first nut 265. One end of the spring 269 is looped around and anchored on pin 249 on the wall 225 or 235 and the other is looped around and anchored on the pin 263 on the lever 251. Sleeves 271 of "Velcro" material or the like (FIGS. 11 and 12) are mounted on the arms 261 to serve as the outer arrow rest surfaces for contact with arrows. The left faces of walls 225 and 235 are covered with similar material as indicated at 273 (FIG. 11).

Figure 15:
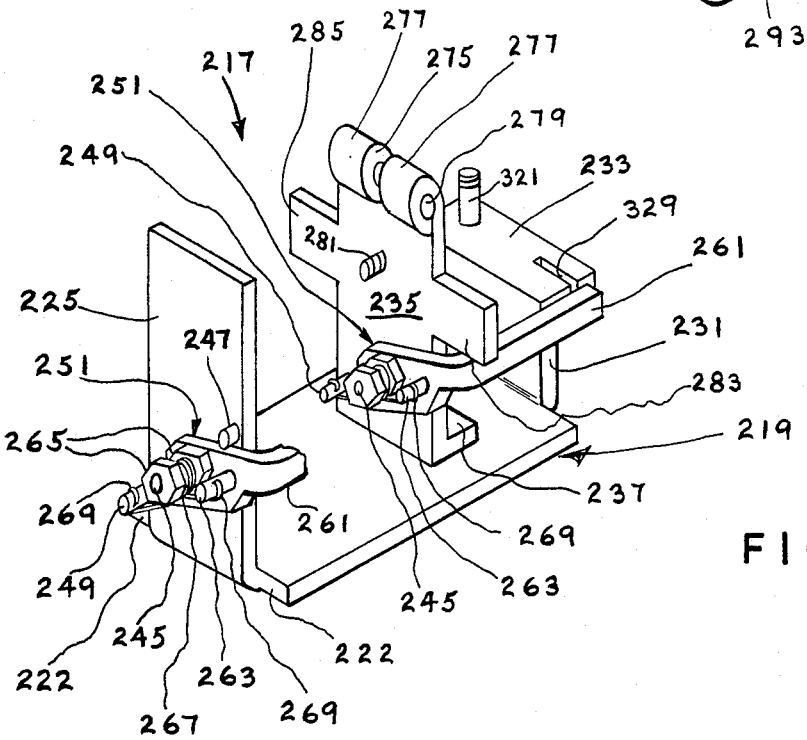
FIG. 15 is a perspective view (with parts omitted) of the carriage assembly used in the loader of FIGS. 11–12.

The wall 235 has its top end centrally slotted at 275 to form two arms 277 that are curled around as shown in FIG. 15 to form a journal aperture 279. Located below the slot 275 and vertically aligned with it, the wall has a threaded opening to receive a threaded pin 281 (FIG. 15). The wall preferably has transverse arms 283 and 285 (FIG. 15) corresponding, respectively, to arms 161 and 162 (FIG. 7).

The wall 235 carries an arrow holder, stabilizer, and clamp means 287 corresponding to arrow holder, stabilizer, and clamp means 91. This includes an arrow holder and stabilizer member 289 which may be formed from the flat metal blank 289' shown in FIG. 18. The blank has a generally rectangular body portion 291 and triangularly shaped side portions 293 each having a pivot pin opening 295 in it. The end opposite to portions 293 has a stubby flange or lip 297 which corresponds to latch lip 113 (FIG. 6). The side portions 293 are bent along lines 299 to extend at right angles to the body portion 291. The body portion 291 is bent at about a right angle along line 301, at the apex of triangular sections 293, to form pivot section 291*a* and latch section 291*b*. The sides 303 of triangular sections 293 act with the inside of body portion 291*b* to form arrow holding notch portions 305 corresponding to notches 107 (FIGS. 6 and 9).

The arrow holder and stabilizer member 289 is mounted on vertical plate 235 by aligning holes 295 with opposite ends of aperture 279 in journal arms 277. A pivot pin 307 is inserted in the aligned holes and aperture and longitudinally secured in place as by a nut 309 threaded on one end and an enlarged head (not shown) at the other end. A spring wire 311 (FIG. 12) corresponding to spring wire 109 (FIGS. 3 and 6) urges the member 291 to the up or open position and has a center coil (not shown) around pin 307 in slot 275 and one end anchored by nut 313 on pin 281 (FIG. 15) of vertical plate 235 and the other end (not shown) anchored around an anchor screw 315 (FIGS. 11 and 12) threaded into hole 317 (FIG. 18) of body portion 291*a*.

A latch means to hold the member 289 in arrow holding and stabilizing position is very similar to that previously shown and described. It includes a horizontal latch and clamp plate 319 that is pivoted at one end on vertical pin 321 (FIG. 15) which is threaded into hole 322 (FIG. 16) in horizontal flange section 233 of traveler member 219. The plate 319 can be pivoted so that the other end will overlie the latch lip 297 on holder member 289 thereby latching the member against upward movement by the spring wire 311. The latch and clamp plate 319 has a rigid vertical clamp post 323, corresponding to post 127, which serves as a handle to manually pivot the plate 319 to the latching and clamping position of FIG. 11 in which the plate overlies lip 297 and the post 323 presses the follow-up arrow A2 with clamping pressure against the face 273 (including arms 283 and 285) of vertical plate 235. The dimensions are arranged, as previously described, so that the post 323 holds the arrow A2 against tension in elastic cord 325 which is anchored at one end in a hole in the post 323, extends around spacer sleeve 327 on pivot post 321, and is anchored at its other end in a slot 329 in flange 233. A nut 331 threaded on top of pivot pin 321 holds the sleeve 327 in place. The frame 203 includes a vertical barrier or retention wall 333, corresponding to wall 129, which will be engaged by the latch and clamp plate 319 to prevent inadvertent release of the arrow A2 should the normal clamp force be accidentally reduced or lost.

Figure 14:
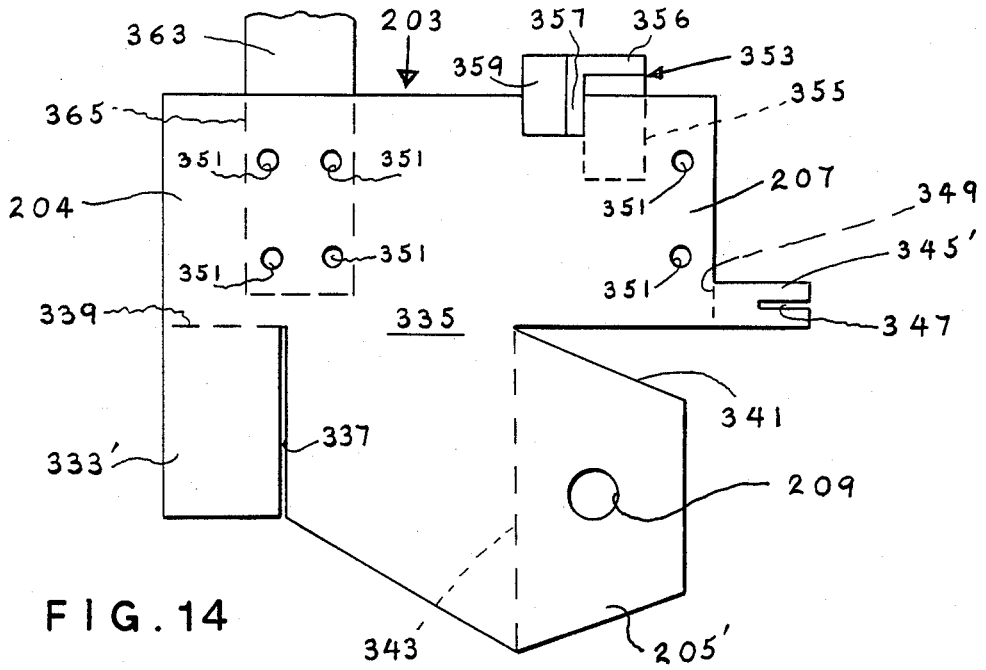
FIG. 14 is a plan view of the support frame of FIGS. 11–13 showing a stage in its formation.
Figure 13:
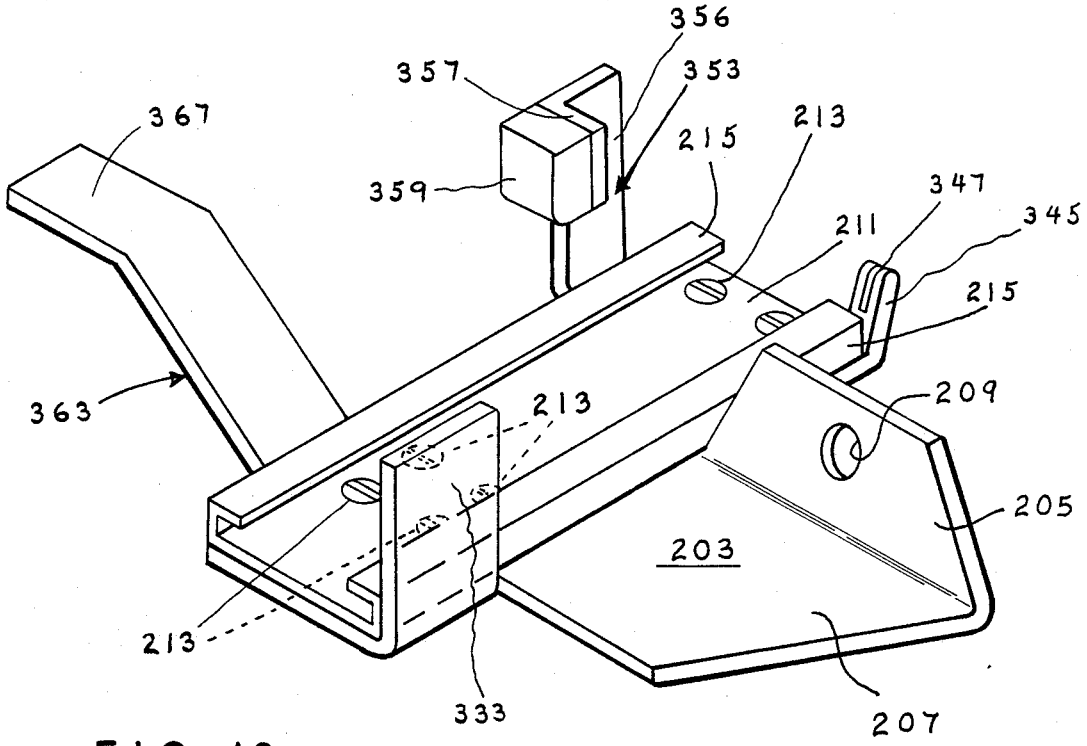
FIG. 13 is a perspective view of the support frame and track used in the loader of FIG. 11.

As seen in FIG. 14, the barrier wall 333 may be a part of a flat metal blank 335 used to form the frame 203. The blank is slotted at 337 to separate the barrier wall forming portion 333' from the adjacent portion of the blank. Portion 333' can then be bent at a right angle along line 339 to form the wall 333. The blank 335 has a V-shaped cutout 341 to define the flange forming portion 205' which is bent at a right angle along line 343 to form the vertical flange 205. The remainder of the blank is roughly of a T-shape and forms the horizontal shelf 207. However, adjacent the notch 341 is a small extension 345' with a slot 347. This is bent up at an angle of about 70 degrees along line 349 to form a vertically extending wall 345 (FIG. 11) that serves as an anchor for one end of the elastic cord spring means to be described. Three pairs of threaded holes 351 are formed in the blank and these receive the countersunk screws 213 (FIG. 13).

A bracket 353 to form a carriage stop and station alignment means has a bottom flange 355 that may be welded to the bottom of the front of the shelf 207 section of the blank 335. The bracket 353 includes a vertical post section 356 (FIG. 13) that has a transverse flange extending over the track 215 to form a stop face flange 357 with a stop face pad 359, corresponding to stop face 159, secured to it. The thickness of pad 359 may be varied to suit the application and provide clearance for level 251 on plate 225. To contact the pad 359, a non-metallic pad 361 may be secured to arm 283 of vertical plate 235.

An arrow stabilizer bracket 363 (corresponding to stabilizer means 181) has a bottom flange 365 with two pairs of threaded openings that register with opening 351 in the shelf 207 whereby two pairs of screws 213 that secure the track channel 211 to the shelf may also be used to secure the bracket 363 to the shelf. The bracket extends upwardly to a top horizontal shelf 367 with a Velcro-type facing 369 that is located on a level with the top of the second arrow rest sleeve 271 to help support and stabilize arrow A2 (FIG. 11).

When the carriage 217 is assembled on the frame 203, the elastic cord 371 is used to provide a spring means that is energized when the carriage is moved to the loaded position of FIG. 11, thereby providing force to automatically move the carriage to the right when the first arrow rest 271 is depressed upon release of first arrow A1. The cord 371 is knotted at its left end and slipped through opening 373 (FIG. 16) in vertical wall 231 of traveler 219. The right end of the cord 371 is then knotted at the appropriate length and the cord slipped into slot 347 of cord anchor wall 345 on the frame 203. The angle of the wall 345 traps the knotted end of the cord 371 to resist any tendency to slip up and out of the slot 347.

The operation of the device 201 of FIGS. 11–18 is substantially the same as that of device 1 and therefore need not be explained. It should be noted that the structural features shown in FIGS. 11–18 promote economy in manufacture without sacrifice in performance or ease of operation.

Figure 19:
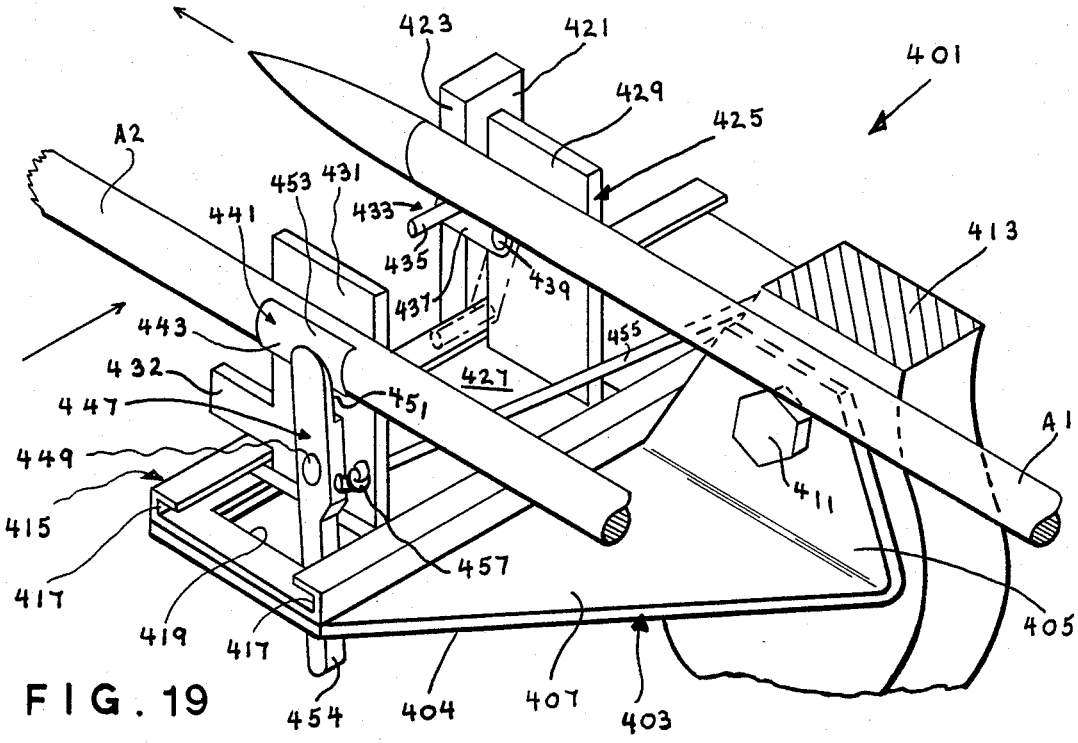
FIG. 19 is a perspective view with parts omitted and broken away showing another form of loader.
Figure 20:
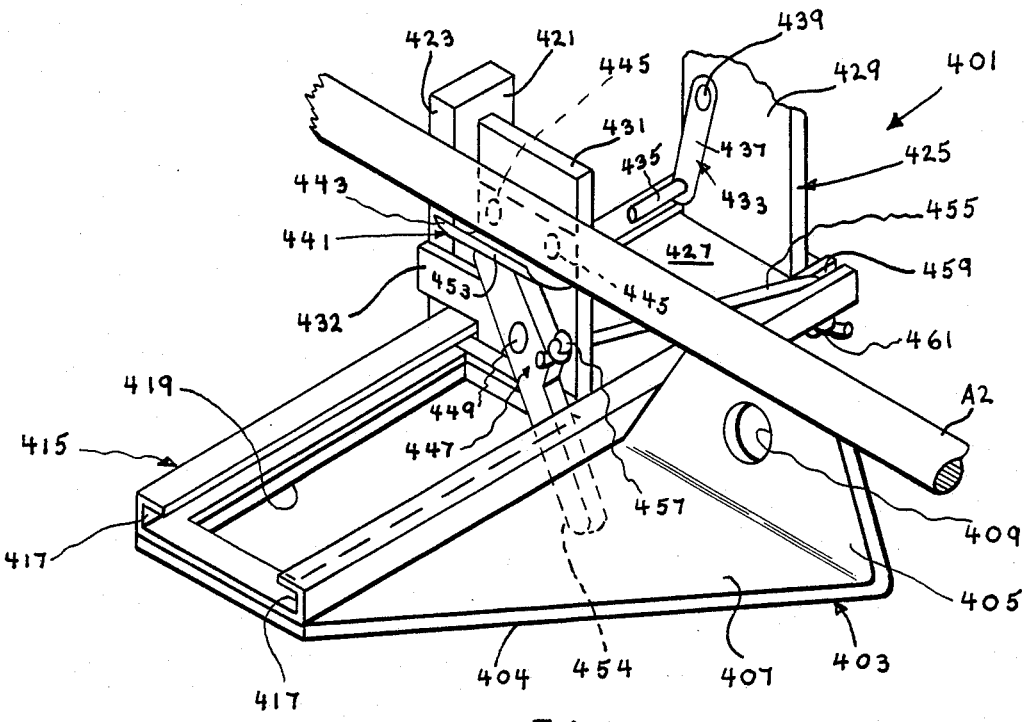
FIG. 20 is a second perspective view of the loader of FIG. 19 showing the carriage after release of the first arrow.

Referring to FIGS. 19 and 20, a simplified form of two station arrow loader 401 is illustrated that omits several features present in the loaders 1, 1', and 201 but is less costly to manufacture. The loader 401 has a support frame 403, similar to the previous frames, which includes a plate 404 vertical flange 405 and a horizontal shelf 407, the flange 405 having a hole 409 to receive bolt 411 for attaching the frame and loader to the bow 413. A C-shaped channel 415 is secured to the top of the shelf 407 and provides front and rear tracks 417. The shelf 407 and the channel 415 each have a large rectangular opening and these are vertically aligned to provide a large opening 419. The frame 403 also has a vertical post 421 affixed to the front of shelf 407 which has a vertical stop face 423 corresponding to stop faces 159 and 359.

A carriage assembly 425 for initial and follow-up arrow A1 and A2 includes a bottom plate 427 having front and rear longitudinal edges which slide in the tracks 417. The right end of the plate is bent up into a vertical wall 429 for the first station (initial arrow A1). A second vertical wall 431 for the second station (follow-up arrow A2) is affixed to the other end of the plate 427. It has an arm 432 (corresponding to arms 161 and 283) that is engageable with stop face 423 to locate the follow-up arrow A2 in the shooting position.

The arrow rest 433 for the arrow A1 comprises a substantially horizontal pin 435 which is rigid with one end of a lever 437, the other end of the lever 437 being pivoted by pin 439 to the left side of the wall 429.

The arrow rest and arrow holder 441 for the arrow A2 comprises a flexible trough 443 formed of elastic sheet material having a curved shape as shown in FIG. 20. One edge of the trough 443 is securely attached to the left face of the vertical wall 431 as indicated by pins 445. A holder lever 447 in opening 419 is connected by centrally located pivot pin 449 to the wall 431 and when in its vertical and operative position (FIG. 19) has a top portion 451 shaped to bend the left edge 453 of the flexible trough 443 into an arrow holding, stabilizing, and clamping position around the arrow A2 as shown in FIG. 19. It has a bottom portion 454 that extends down through opening 419 below the bottom of the frame 403 where it is accessible to and operable by a finger of the left hand of the archer. If the archer pulls on the portion 454, the top portion 451 will move from the operative position of FIG. 19 to the inoperative position of FIG. 20. In this position, the expanded trough serves as an arrow rest for the follow-up arrow A2 which can be shot when the trough is brought by carriage 425 into the shooting position.

As in previous embodiments, the carriage assembly 425 is automatically moved to the right, after initial arrow A1 is released, by tension in an elastic rod 455. The left end of cord 455 has a knot 457 that engages the left side of wall 431 while the cord passes through a hole (not shown) in wall 431. At the right end of the frame the cord extends through a slot 459 in the right end of the rear track of the channel 415. A knot 461 in the right end of the cord engages the bottom of the channel (FIG. 20) to hold the cord in place. As in previous embodiments, only a very small amount of sideways movement is needed to bring the follow-up arrow into shooting position. The spacing of the stations and arrows can be very small (less than previous embodiments because the latch mechanism is not used) and determined primarily by the fletching of the arrows.

Contrary to the previous embodiments, the follow-up arrow is manually released from the arrow holding, stabilizing, and clamping mechanism 441. When the follow-up arrow A2 reaches the shooting position (FIG. 2), the archer can use a finger of his left hand to pull back on the bottom of lever 447 thereby placing arrow A2 in shooting condition.

Contrary to the previous embodiments, the device 401 illustrates a last station (for arrow A2) that does not have a movable arrow rest capable of acting as a switch to actuate movement of the carriage. In devices 1, 1', 201, and 401 it is not necessary for the last station to have a movable arrow rest though the movable arrow rest is preferable to minimize deflection of the arrows.

Figure 21:
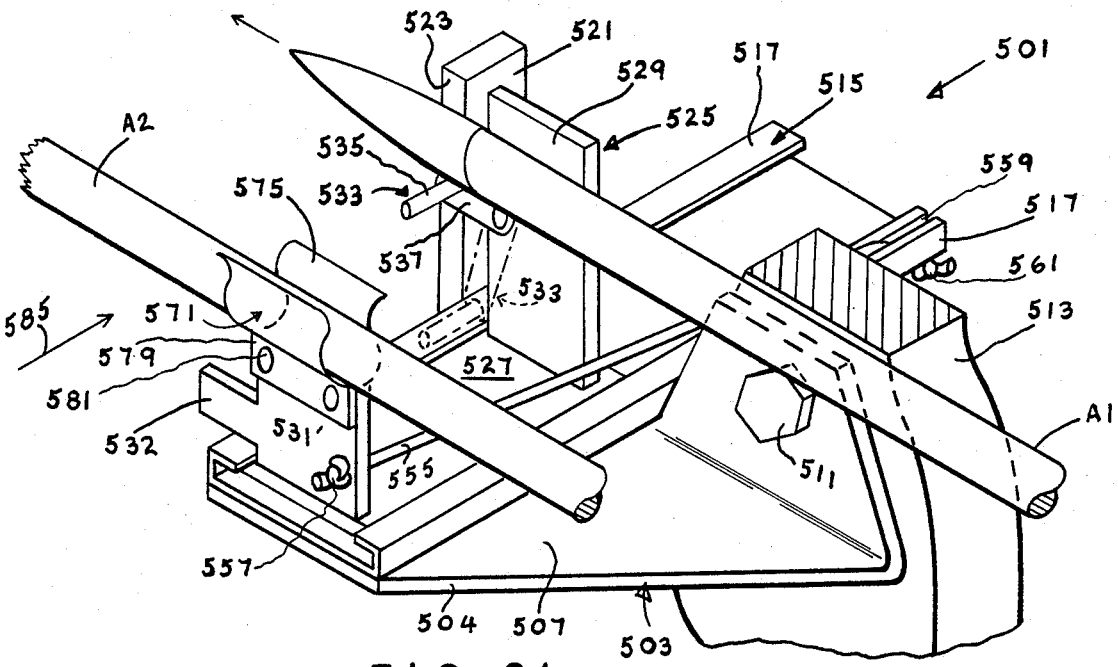
FIG. 21 is a perspective view with parts omitted and broken away showing still another form of loader.
Figure 23:
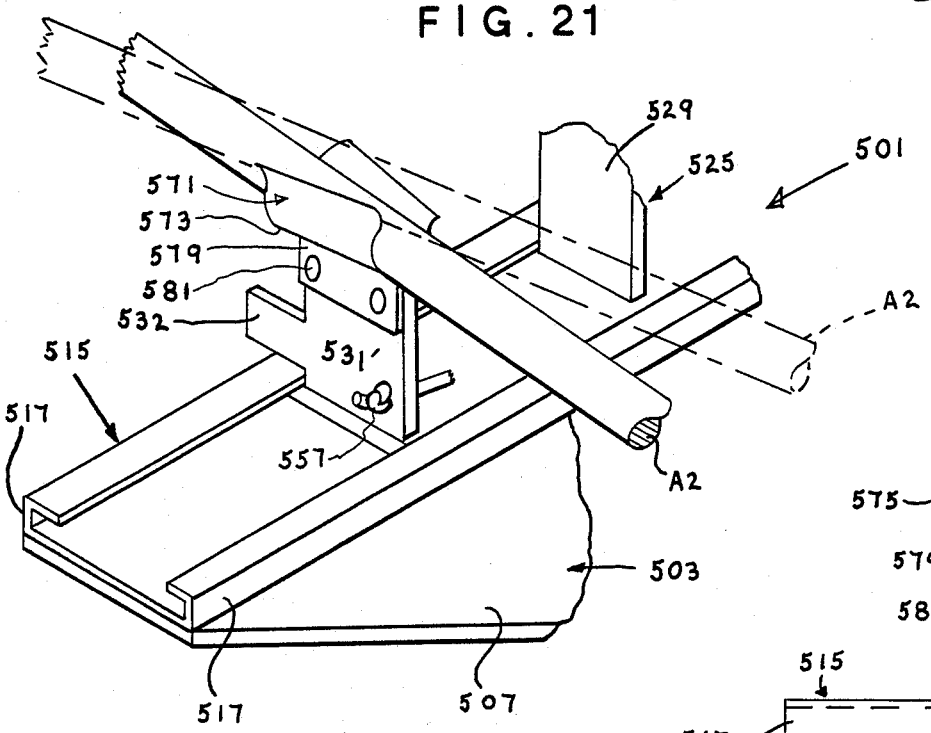
FIG. 23 is a perspective view similar to FIG. 21 but showing the carriage in a first arrow released position and illustrating operation of the arrow support.
Figure 22:
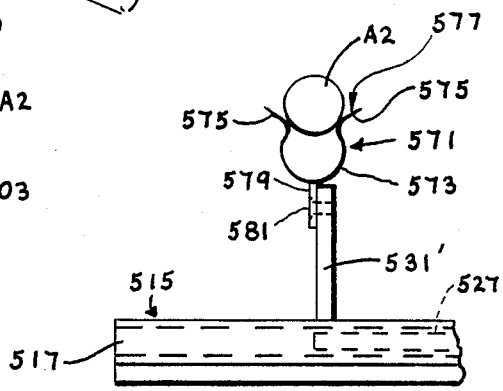
FIG. 22 is a schematic view illustrating the operation of the arrow support used in the loader of FIG. 21.

FIGS. 21–23 show another form of loader 501. This loader has many of the same structural features as loader 401. These are given the same reference numbers in FIGS. 21–23 but with 100 added. Parts are omitted in FIG. 22 for clarity. The difference between loaders 401 and 501 is in the arrow rest, holding, stabilizing, and clamping means 571 at the second station for follow-up arrow A2.

The vertical plate 531' for the arrow A2 is shorter than its counterpart plate 431 but does have an arm 532 (corresponding to arm 432) that is engageable with stop face 523 to align the second station with the shooting position. The arrow rest, holding, stabilizing, and clamping means 571 is formed of elastic sheet material and has a bottom partially circular (more than 180 degrees) arrow holding, stabilizing, and clamping section 573 with diverging top sides 575 that are spaced apart by less than the diameter of the arrow and define a triangularly or V-shaped arrow rest section 577. The arrow rest is located on the center line of the bow and in the shooting position when the arm 252 is in contact with face 523. The holder 571 may be formed of two halves with flat bottom flanges 579 in face to face contact and secured as by pins or screws 581 to the vertical wall 531'.

As in previous embodiments, the follow-up arrow A2 is automatically moved sideways into the plane of the bow when initial arrow A1 is shot. Contrary to previous embodiments, it then must be manually angled by the archer out of the grip of section 573 until it rests on sides 575 where it is then on the center line of the bow, or shooting position, and ready to be shot.

Figure 24:
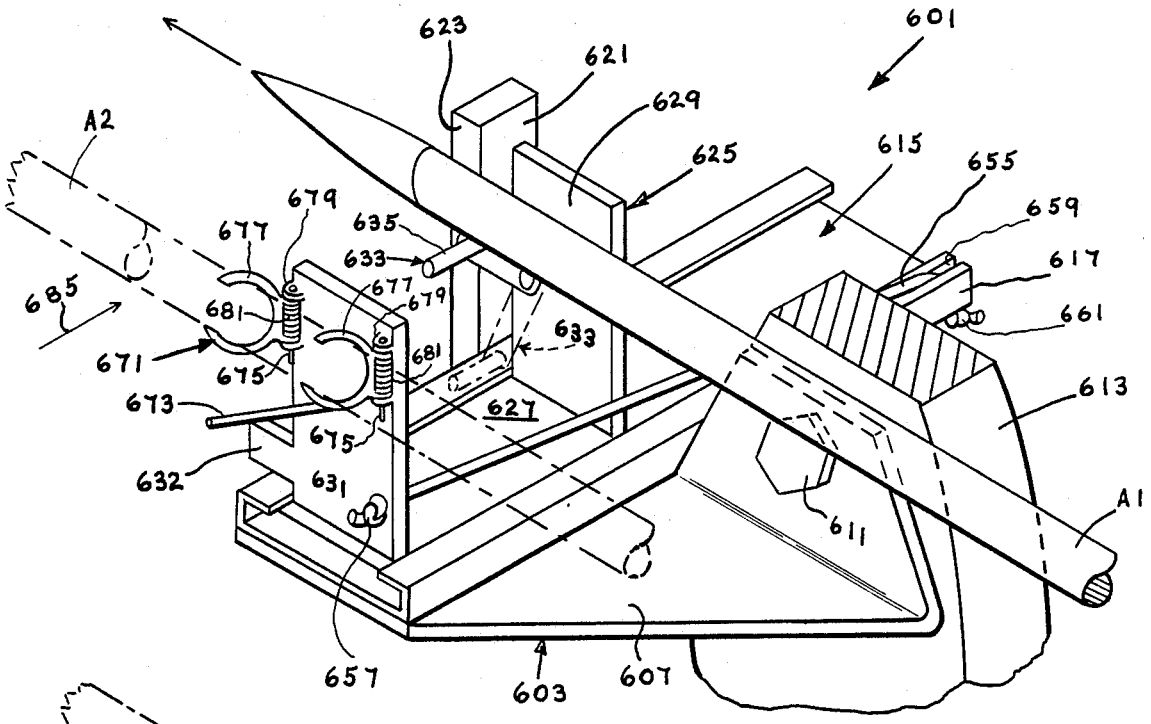
FIG. 24 is a perspective view with parts omitted and broken away showing yet another form of loader.
Figure 25:
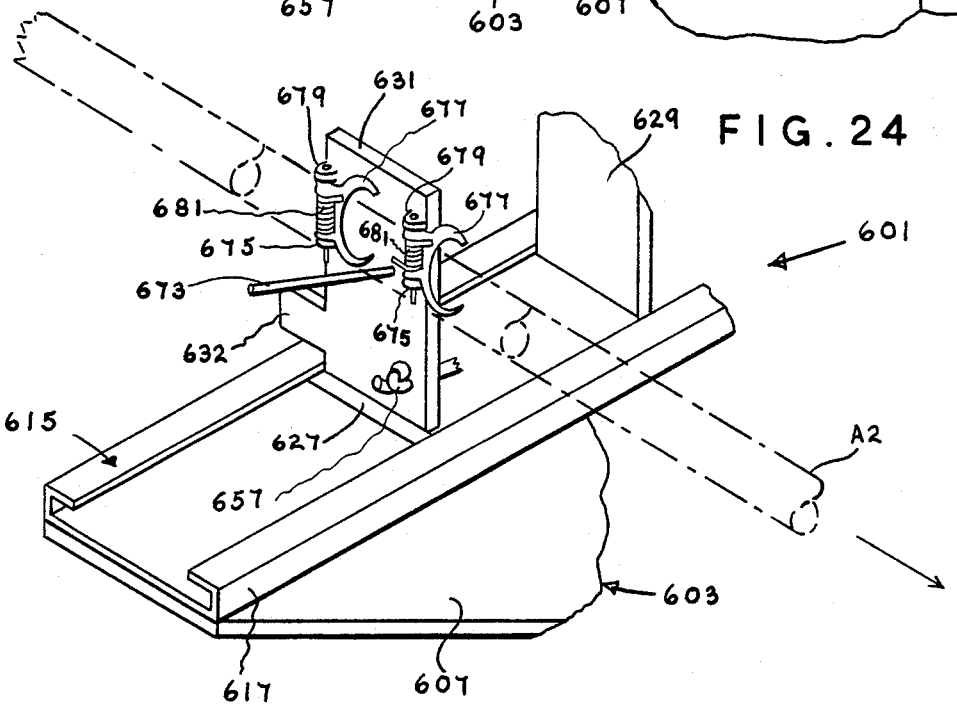
FIG. 25 is a perspective view of the loader of FIG. 24 showing operation of the arrow rest and holding means in the arrow released position.

FIGS. 24 and 25 illustrate still another form of loader 601. This loader, like loader 501, has many of the structural features of loader 401. These are given the same reference numbers in FIGS. 24 and 25 as in FIGS. 19 and 20 but with 200 added. The difference between loader 601 and loaders 401 and 501 is in the arrow rest, holding, stabilizing, and clamping means 671 at the second station for the follow-up arrow A2.

The means 671 includes a fixed arrow rest pin 673 rigidly secured to the vertical wall 631 and projecting to the left and angled upwardly away from the archer. It supports the follow-up arrow A2 in shooting position when stop member arm 632 engages top face 623. The means 671 also includes identical and aligned front and rear arrow holders and clamps 675 which act together to help hold, clamp, and stabilize arrow A2 while it is in a pre-shooting position. Each holder 675 has a resilient C-shaped arrow receiver member 677 sized to tightly but releasably embrace the arrow A2. Each receiver member 677 is secured by a hinge member 679 to the left side of wall 631 for pivotal movement between the operative position of FIG. 24 (in which it extends perpendicularly to the wall 631) and the inoperative position of FIG. 25 (in which it lies against and parallel to the wall 631). A coil spring 681 on the hinge pin acts between the hinge and the receiver 677 to urge the receiver to the inoperative position of FIG. 25.

As in previous embodiment, the follow-up arrow A2 is automatically moved sideways into shooting position by carriage 625 when first arrow A1 is shot. Contrary to previous embodiments (except 501), it then must be manually extracted by the archer from receiver members 677. These then go against the wall 631 and arrow A2 is supported in shooting position on arrow rest 673.

Figure 26:
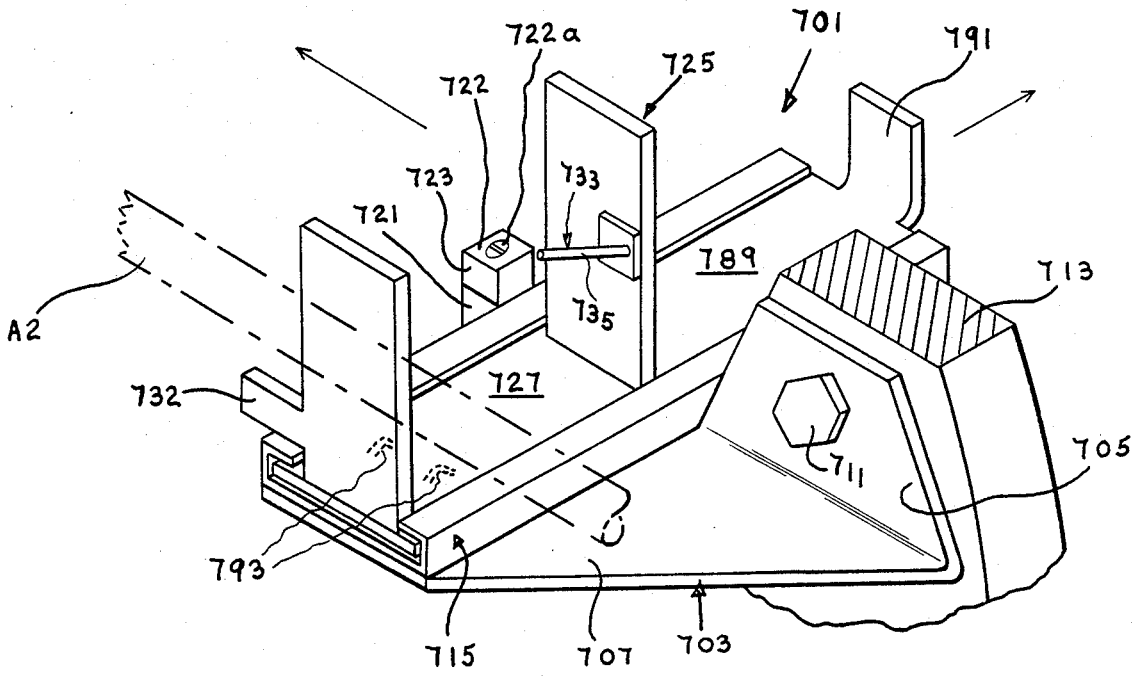
FIG. 26 is a perspective view with parts omitted and broken away of a loader in which the carriage is moved manually instead of by spring force.
Figure 27:
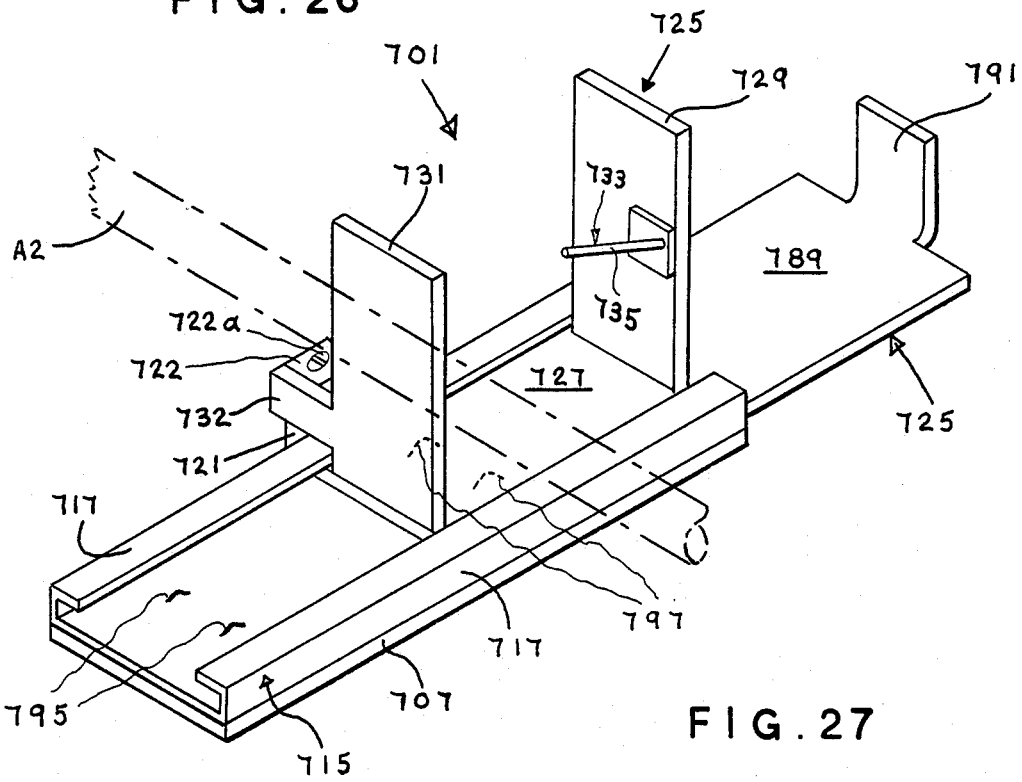
FIG. 27 is a perspective view of the loader of FIG. 26 showing the carriage moved into position for release of the second arrow.

FIGS. 26 and 27 illustrate a holder 701 having a carriage that is indexed to the right by the archer instead of by a spring means. The frame of loader 701 has many structural features of holder 401. These are given the same reference numbers but with 300 added. However, the stop post 721 of frame 703 is somewhat different from stop post 421. Post 721 is shorter and has a magnetic block 722 attached by screw **722*a* on top of it. The block 722 has a stop face 723**.

The carriage means 725 has a bottom plate 727 with front and rear edges that slide in tracks 717. A first vertical plate 729 providing the first station for arrow A1 (omitted in these Figures for clarity) and a second vertical plate 731 providing the second station for follow-up arrow A2 are rigid with the plate 727. Plate 731 has a transverse stop arm 732 that is in alignment with magnetic block 722 and stop face 723. If plate 731 is made of steel, it will be magnetically held against stop face 723. If the plate 731 is made of non-magnetic material, a pad (not shown) capable of being magnetically held by magnet 722 should be attached to the right side of arm 732. The first vertical plate has an arrow rest 733 in the form of an upwardly inclined pin 735 (corresponding to pin 673 of FIGS. 24 and 25). For clarity, the arrow rest and holder means for arrow A2 is omitted, but it could, for example, be like the means 571 in FIGS. 21 and 22 or the means 671 in FIGS. 24 and 25.

In accordance with this form of the invention, the bottom plate 727 is extended for some distance to the right of first vertical plate 729 as shown in 789. At the right end of extended bottom plate portion 789 is an upwardly extending vertical handle flange 791. The inside face of the flange 791 may be engaged by the right thumb or other finger of the archer to apply force to the carriage to move it to the right from the arrow A1 shooting position of FIG. 26 to the arrow A2 shooting position of FIG. 27.

Suitable means are provided to yieldably hold the carriage 725 in the position of FIG. 26. This is illustrated as a dimple means 793 comprising a pair of upwardly extending dimples 795 in the floor of frame channel 715 and a pair of corresponding dimple receiving recesses 797 in the bottom of plate 727. When manual pressure to the right is applied to flange 791 by the archer, the carriage 725 will move out of the dimple means 793 until arm 732 engages stop face 723. This is the shooting position for follow-up arrow A2. The magnetic block 722 holds the carriage in position for shooting of arrow A2 while the dimple-means holds the carriage in position (FIG. 26) for shooting of the first arrow (A1—not shown).

Figure 28:
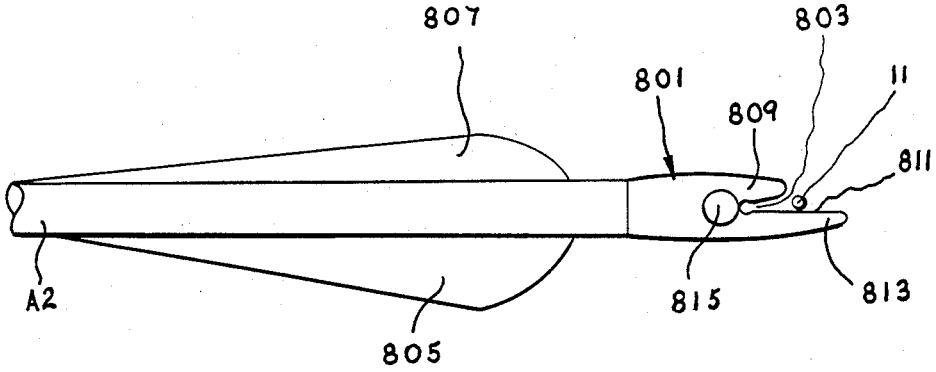
FIG. 28 is a somewhat schematic top view showing use of a nock according to a feature of the invention.
Figure 29:
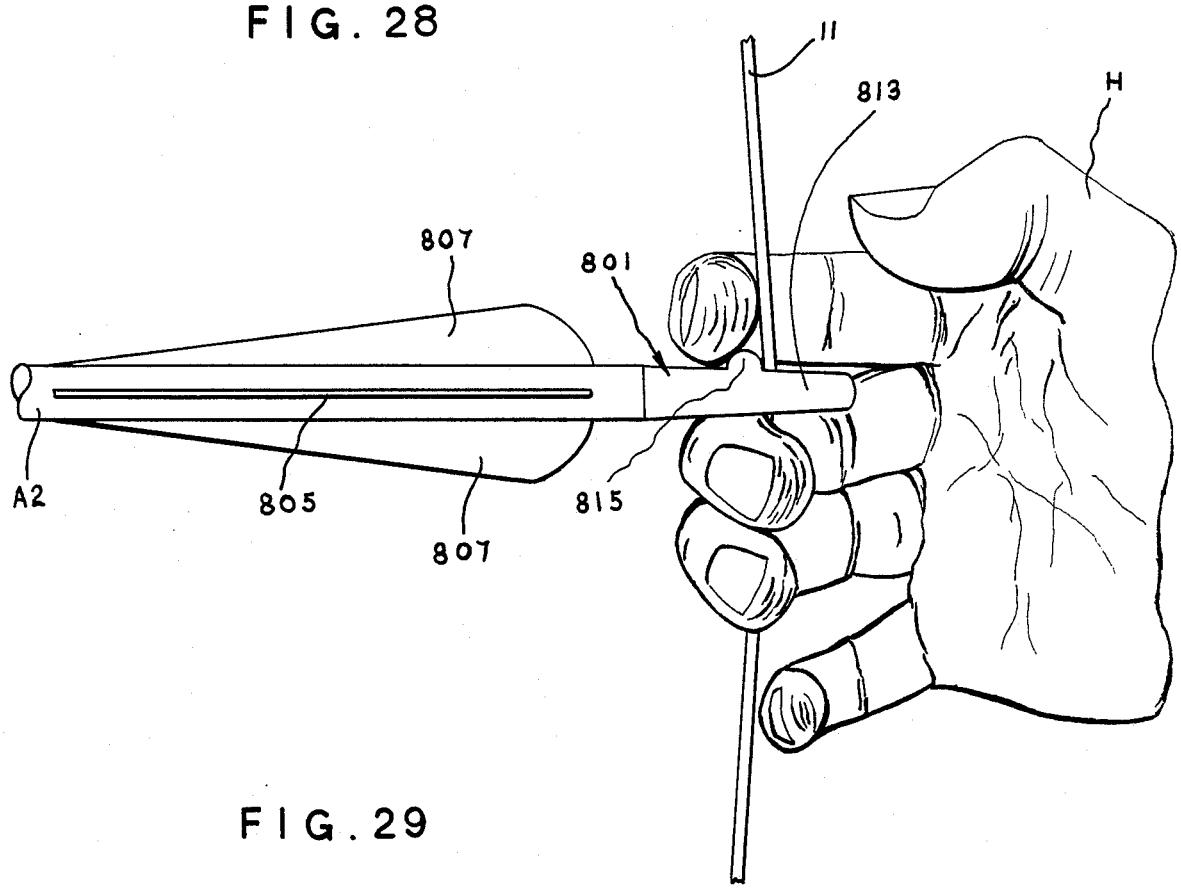
FIG. 29 is a side view of the nock usage as shown in FIG. 28.

FIGS. 28–19 illustrate a special nock 801 that I prefer to use with the automatic forms of my invention. (The nock of these Figs. is also shown at N in FIGS. 1, 2 and 10). A rear portion of a follow-up arrow A2 is shown having the nock 801 at the end ready for nocking on bow string 11 by the right hand H of the archer. The nock 801 has the usual bow string groove 803. The arrow has the cock vane 805 at a right angle to the groove 803 and then hen vanes 807 spaced 120 degrees from it as is conventional. According to the invention, the nock wall 809 on the right side of groove 803 is very short. Thus, the inside face 811 of the normal left wall 813 (on a follow-up arrow A2, A3, etc., that is placed in the loader so that face 811 is transversely aligned with string 11) will be laid up against the bow string 11 by the loader of the invention when the follow-up arrow is automatically brought into shooting position. This is shown in FIG. 28. FIG. 29 illustrates the short pull required to achieve nocking.

As a further feature to facilitate drawing, the nock 801 has a knob 815 on top. FIG. 29 shows how this will assist the archer in pulling the arrow A2.

The various arrow holding and loading devices that have been illustrated and described in the preceding description show that my invention may be embodied in different specific forms. The forms described all utilize a straight horizontal feed path, perpendicular to the plane of the bow, in which one or more securely held follow-up arrows are moved sideways or transversely to their lengths by automatic or manual means for pre-shooting positions into the shooting position. At the present time I believe that this type of feed path is preferred. However, it is within the broad purview of the invention to feed the follow-up arrows sideways on an inclined path or an arcuate path to the shooting position. It will be appreciated that these and other modifications of the constructions that are illustrated and described are within the broad spirit and scope of the invention.

I claim:

1. An arrow loader for an archery bow, said bow having a shooting position, said arrow loader comprising means for supporting a first arrow on said bow in said shooting position, means including an arrow rest for supporting a follow-up arrow on said bow in a pre-shooting position parallel to a first arrow in the shooting position, and means for moving the arrow rest and follow-up arrow transversely to its length into the shooting position wherein the arrow is aligned and ready for nocking, drawing, aiming and release by the archer.

2. An arrow loader for an archery bow, said bow having a shooting position for an arrow, said arrow loader comprising a carriage, means for supporting the carriage on the bow for movement relative to said shooting position, means for supporting a first arrow on the carriage, means for supporting a follow-up arrow on the carriage, means for moving the carriage so that the first arrow is in said shooting position, and means actuated by contact with the first arrow during shooting of the first arrow for moving the carriage so that the follow-up arrow is in the shooting position.

3. An arrow holding and loading device for an archery bow having a shooting position for an arrow wherein the arrow is in appropriate alignment for nocking on the bowstring and drawing, aiming, and release by the archer, said device comprising a carriage having first means for holding a follow-up arrow in a pre-shooting position wherein said arrow is substantially parallel to but transversely separated from an arrow in said shooting position, second means for supporting the carriage on the bow to provide for transverse movement of the carriage to move said follow-up arrow from said transversely separated pre-shooting position into said shooting position, and third means for the application of force to transversely move said carriage so that said arrow moves from said pre-shooting position to said shooting position.

4. An arrow holder and loader for an archery bow having a shooting position for an arrow, said arrow holder and loader comprising a frame, a carriage movable mounted on the frame for linear movement transverse to said shooting position for an arrow, said carriage including means for supporting an arrow in a pre-shooting position substantially parallel to but transversely spaced from said shooting position for an arrow, and means for indexing the carriage to bring said arrow substantially into said shooting position.

5. An arrow loader as set forth in claim 4 wherein said frame includes means for rigidly securing it to the bow.

6. An arrow loader as set forth in claim 4 wherein said frame includes a track means defining a horizontal linear track transverse to said shooting position for an arrow, said carriage being mounted on said track for horizontal linear movement transverse to said shooting position of an arrow.

7. An arrow holding and loading device for an archery bow, said bow having a shooting position for an arrow, said device comprising a frame, a carriage mounted on the frame for movement toward and away from said shooting position, said carriage having a first station including an arrow rest for supporting a first arrow so that it is ready to be shot, mechanical means for positioning said carriage in a first position wherein said first arrow is supported by said first station in said shooting position and in a second position wherein said second arrow is supported by said second station in said shooting position, and carriage moving means for moving said carriage from said first position to said second position.

8. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position.

9. A device as set forth in claim 8 wherein said carriage moving means comprises a spring means.

10. A device as set forth in claim 9 wherein said first means includes a movable member capable of being moved by the first arrow when the first arrow is shot, connecting means operatively connecting said movable member to said mechanical means whereby said carriage is released from said first position by movement of the movable member and is moved by said spring means to said second position.

11. A device as set forth in claim 10 including a movable stop face member mounted on said frame and adapted to be moved to an operative position wherein it blocks movement of the carriage and holds the carriage in the first and second positions, said member being manually operated by the archer.

12. A device as set forth in claim 8 wherein said second means includes releasable means for holding said follow-up arrow in said pre-shooting position and arrow rest means for supporting said follow-up arrow in said shooting position wherein said arrow is aligned and ready for nocking, drawing, aiming, and release by the archer.

13. A device as set forth in claim 12 wherein said releasable means is operated to release by predetermined movement of said follow-up arrows.

14. A device as set forth in claim 13 wherein said predetermined movement is axial and comprises drawing of the follow-up arrow for nocking by the archer.

15. A device as set forth in claim 12 wherein said releasable means is adapted to engage said follow-up arrow at a plurality of axially separated points along its length whereby to firmly hold it in its pre-shooting position.

16. A device as set forth in claim 8 wherein said mechanical means includes a stop face member mounted on said frame and a stop member mounted on the carriage and engageable with the stop face member, said stop member being yieldably urged into engagement with the stop face member and movable out of engagement with the stop face member to allow movement of said carriage.

17. A device as set forth in claim 16 including means mounting the stop member on the carriage so that contact with an arrow upon shooting of the arrow moves the stop member out of engagement with the stop face member.

18. An arrow holding and loading device for an archery bow, said bow having a shooting position for an arrow, said device comprising a frame, a carriage mounted on the frame for movement toward and away from said shooting position, said carriage having a first means for supporting a first arrow to be shot to that said first arrow is in said shooting position, said carriage having a second means for supporting a follow-up arrow in a pre-shooting position wherein it is substantially parallel to the first arrow supported by the first means, mechanical means for positioning said carriage in a first position wherein said arrow is supported by said first means in said shooting position and in a second position wherein said second arrow is supported by said second means in said shooting position, and carriage moving means for moving said carriage from said first position to said second position, said spring means comprising an elongated elastic cord having a length greater than the length of the carriage.

19. A device as set forth in claim 18 wherein said carriage includes a one piece member having a base portion adapted to movably engage said frame, said member having a first flange at one end extending at a right angle to said base portion and comprising a portion of said first means, said one piece member having a second flange at its other end extending at a right angle to said base portion, said elastic cord being anchored at one of its ends to said second flange.

20. A device as set forth in claim 19 wherein said second flange includes a top portion extending at a right angle so that it is substantially parallel to said base portion and extending away from the first flange, said second means including a clamp member pivotally mounted on said top portion.

21. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said carriage moving means comprising handle means on the carriage to receive transverse force applied by a hand of the archer.

22. A device as set forth in claim 21 wherein said mechanical means includes dimple means for yieldably positioning and holding the carriage in the first position and magnetic stop face means for yieldably positioning and holding the carriage in the second position.

23. An arrow holding and loading device for an archery bow, said bow having a shoorint position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said carriage moving means comprising spring means, said first means including a movable member capable of being moved by the first arrow when the first arrow is shot, connecting means operatively connecting said movable member to said mechanical means whereby said carriage is released from said first position by movement of the movable member and is moved by said spring means to said second position, said movable member comprising an arrow rest for supporting said first arrow in said shooting position.

24. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said second means including releasable means for holding said follow-up arrow in said pre-shooting position and arrow rest means for supporting said follow-up arrow in said shooting position, said releasable means being operated by predetermined movement of said follow-up arrow, said predetermined movement being non-axial and comprising sidewise movement of the arrow by the archer.

25. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said second means including releasable means for holding said follow-up arrow in said pre-shooting position and arrow rest means for supporting aid follow-up arrow in said shooting position, said releasable means including an elastic member and a lever means for biasing the elastic member to a position around a portion of the follow-up arrow, said lever means including a portion operated by the archer to move the lever means so that it allows the elastic member to move from said position around a portion of the follow-up arrow, said elastic member also serving as said arrow rest means.

26. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said second means including releasable means for holding said follow-up arrow in said pre-shooting position and arrow rest means for supporting said follow-up arrow in said shooting position, said second means including a vertical wall on said carriage, said releasable means being mounted on said vertical wall.

27. A device as set forth in claim 26 wherein said arrow rest means is mounted on said vertical wall.

28. A device as set forth in claim 27 wherein said releasable means comprises a pair of C-shaped arrow gripping members mounted on said wall above said arrow rest means and adapted to yieldably embrace and hold said follow-up arrow, said gripping members being hinged to said vertical wall and spring biased to an inoperative position flat against the wall.

29. A device as set forth in claim 26 wherein said releasable means comprises a pair of resilient members at the top of said vertical wall defining a cylindrical trough having resilient walls and an opening on top to receive said follow-up arrow, said opening being of less width than the diameter of the follow-up arrow, said trough having a diameter substantially the same as said arrow, said resilient members having top portions extending outwardly from opposite sides of said opening to form a substantially V-shaped support for said follow-up arrow, said support providing said arrow rest means.

30. A device as set forth in claim 26 wherein said releasable means includes a movable clamp member for applying transverse force to said follow-up arrow and clamping it against said vertical wall.

31. A device as set forth in claim 30 wherein said clamp member is constructed and arranged to be moved away from said follow-up arrow upon axial movement of said arrow toward the archer and thereby remove said transverse clamping force on said arrow.

32. A device as set forth in claim 31 including spring means urging said clamp member to move away from said follow-up arrow.

33. A device as set forth in claim 32 wherein said spring means comprises an elongated elastic cord connected at one end to the clamping member and at the other end to said carriage.

34. A device as set forth in claim 33 including an arrow holder and stabilizer member movably mounted on said vertical wall and adapted in a closed and operative position to embrace said follow-up arrow and hold it against said wall, said arrow holder and stabilizer member being yieldably biased to an open and inoperative position out of the way of axial movement of the follow-up arrow, and movable latch means engageable with said arrow holder and stabilizer member for latching it in said closed and operative position.

35. A device as set forth in claim 34 including retention means on the frame and engageable with the latch means to prevent unlatching movement thereof until the carriage has moved substantially to said second position.

36. A device as set forth in claim 35 wherein said latch means and said clamp member are connected to move together.

37. A device as set forth in claim 35 wherein said frame comprises a one piece member having a horizontal shelf portion and a flange extending at a right angle to the shelf portion and adapted to be secured to the bow, said one piece member having a wall extending at a right angle to the shelf portion and providing said retention means, said one piece member having an end flange extending at an angle to said shelf portion and containing a slot, said carriage being movably mounted on said shelf portion, said carriage means comprising an elastic cord connected at one end to said carriage and at its other end fitting in said slot and being connected to said end flange.

38. A device as set forth in claim 35 wherein said latch means includes said clamp member.

39. A device as set forth in claim 38 wherein said latch means includes a latch ear on said arrow holder and stabilizer member and a latch plate movable over the ear to hold the member in closed position.

40. A device as set forth in claim 39 wherein said clamp member comprises a vertical post on said latch plate.

41. A device as set forth in claim 40 wherein said arrow holder and stabilizer member is pivotally mounted on a horizontal axis to the top of said vertical wall and said latch plate is pivotally mounted on a vertical axis spaced horizontally from said wall.

42. A device as set forth in claim 26 including an arrow holder and stabilizer member movably mounted on said vertical wall and adapted in a closed and operative position to embrace said follow-up arrow and hold it against said wall, said arrow holder and stabilizer member being yieldably biased to an open and inoperative position out of the way of axial movement of the follow-up arrow, and movable latch means engageable with said arrow holder and stabilizer member for latching it in said closed and operative position.

43. A device as set forth in claim 42 wherein said first means includes a vertical wall on said carriage and an arrow rest for the first arrow mounted on said wall.

44. A device as set forth in claim 43 including movable means mounting said first means arrow rest on said first means wall so that engagement of the arrow rest by a radially projecting portion of the first arrow during shooting of the first arrow moves the arrow rest, said movable means being operatively connected to said mechanical means whereby said carriage is released from said first position by movement of the arrow rest during shooting of the first arrow.

45. A device as set forth in claim 44 wherein said second means includes movable means mounting said second means arrow rest means on said second means vertical wall so that engagement of the arrow rest means by a radial projection on the follow-up arrow during shooting of the follow-up arrow moves the arrow rest means, said second means movable being operatively connected to said mechanical means whereby said carriage is released from said second position by movement of the arrow rest means during shooting of the follow-up arrow, said carriage having a third means for supporting a second follow-up arrow in a pre-shooting position wherein it is substantially parallel to the first arrow and the follow-up arrow supported by the first and second means respectively, said mechanical means positioning said carriage in a third position wherein said second follow-up arrow is supported by said third means in said shooting position.

46. A device as set forth in claim 26 wherein said first means includes a vertical wall on said carriage and an arrow rest for the first arrow mounted on said wall.

47. A device as set forth in claim 46 including movable means mounting said first means arrow rest on said first means wall so that engagement of the arrow rest by a radial projection on the first arrow during shooting of the first arrow moves the arrow rest, said movable means being operatively connected to said mechanical means whereby said carriage is released from said first position by movement of the arrow rest during shooting of the first arrow.

48. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said arrow is supported by said first means in said shooting position and in a second position wherein said second arrow is supported by said second means in said shooting position, carriage moving means for moving said carriage from said first position to said second position, said second means including releasable means for holding said follow-up arrow in said pre-shooting position and arrow rest means for supporting said follow-up arrow in said shooting position, and follow-up arrow stabilizer shelf means mounted on said frame and located in front of the carriage and providing a shelf to support the front end of a follow-up arrow held on the carriage in the pre-shooting position.

49. An arrow holding and loading device for an archery bow, said bow having a shooting position for an arrow, said device comprising a frame, a carriage mounted on the frame for movement toward and away from said shooting position, said carriage having a first means for supporting a first arrow to be shot so that said first arrow is in said shooting position, said carriage having a second means for supporting a follow-up arrow in a pre-shooting position wherein it is substantially parallel to the first arrow supported by the first means, mechanical means for positioning said carriage in a first position wherein said first arrow is supported by said first means in said shooting position and in a second position wherein said second arrow is supported by said second means in said shooting position, and carriage moving means for moving said carriage from said first position to said second position, said mechanical means including stop face member mounted on said frame and a top member mounted on the carriage and engageable with the stop face member, said stop member being yieldably urged into engagement with the stop face member and movable out of engagement with the stop face member to allow movement of said carriage, means mounting the stop member on the carriage so that shooting of an arrow moves the stop member out of engagement with the stop face member, and cam means for moving the stop member out of engagement with the stop face member when the carriage is moved in a direction opposite to the operative direction wherein it brings a follow-up arrow up to the shooting position.

50. A device as set forth in claim 49 wherein said stop member comprises an arrow rest for supporting an arrow.

51. In an arrow loader for an archery bow having a bow string and a shooting position for an arrow, first means for holding a follow-up arrow in a pre-shooting position parallel to said shooting position and in the same horizontal plane as the shooting position and with the nock of the arrow substantially aligned transversely with the bow string, second means for moving the first means transversely in said horizontal plane so that the follow-up arrow is brought to said shooting position with the nock of the arrow substantially in contact with the bow string, and third means for releasably holding the second means in position when the follow-up arrow is in said shooting position.

52. The loader of claim 51 wherein said pre-shooting position is spaced from said shooting position by a distance of substantially 1 to 1½ inches.

53. An arrow nock for use on arrows that are to be loaded on to a bow by sideways movement of the arrow, said nock comprising a body having a groove for the bow string, said groove dividing the body into a leading side and a trailing side with respect to said sideways movement, said leading side being substantially shorter than the trailing side whereby the arrow may be moved sideways until the inside face of the trailing side comes into contact with the bow string.

54. A nock as set forth in claim 53 including a pull knob on the top of the nock.

* * * * *